US012644246B2

(12) United States Patent
Falzone et al.

(10) Patent No.: US 12,644,246 B2
(45) Date of Patent: Jun. 2, 2026

(54) EMBEDDING ANCHORS IN AN UNDERWATER FLOOR

(71) Applicant: RCAM Technologies, Inc., Boulder, CO (US)

(72) Inventors: Gabriel David Falzone, Los Angeles, CA (US); Mason James Bell, Long Beach, CA (US); Jason Rust Cotrell, Boulder, CO (US); Taylor Anthony Marchment, Long Beach, CA (US)

(73) Assignee: RCAM Technologies, Inc., Boulder, CO (US)

( * ) Notice: Subject to any disclaimer, the term of this patent is extended or adjusted under 35 U.S.C. 154(b) by 107 days.

(21) Appl. No.: 18/537,530

(22) Filed: Dec. 12, 2023

(65) Prior Publication Data

US 2024/0191450 A1 Jun. 13, 2024

Related U.S. Application Data

(60) Provisional application No. 63/486,661, filed on Feb. 23, 2023, provisional application No. 63/387,054, filed on Dec. 12, 2022.

(51) Int. Cl.
*E02D 5/80* (2006.01)
*B63B 21/50* (2006.01)

(52) U.S. Cl.
CPC ..... *E02D 5/80* (2013.01); *B63B 21/50* (2013.01)

(58) Field of Classification Search
CPC ..... E02D 5/80; E02D 27/525; E02B 17/20; B63B 21/50; B63B 21/24
See application file for complete search history.

(56) References Cited

U.S. PATENT DOCUMENTS 3,312,295 A * 4/1967 Bodine, Jr. ..... E02D 7/18 175/19
3,811,379 A * 5/1974 Sondheimer ..... F42B 22/12 367/133

(Continued)

FOREIGN PATENT DOCUMENTS

CA 3150664 A1 * 2/2021 ..... E02D 5/801
CN 106005262 A * 10/2016 ..... B63B 21/24

(Continued)

OTHER PUBLICATIONS

English Translated document for CN 114701601 (Year: 2022).*

(Continued)

*Primary Examiner* — Jong-Suk (James) Lee
(74) *Attorney, Agent, or Firm* — Henry Patent Law Firm PLLC

(57) ABSTRACT

In a general aspect, torpedo anchors are described for securing structures to an underwater floor. The torpedo anchors include a cylindrical body and a plurality of fins. The cylindrical body has first and second ends and an exterior cylindrical surface. The plurality of fins are disposed proximate the second end and extend outward from the exterior cylindrical surface. The cylindrical body is formed of cementitious material, and each of the plurality of fins is formed at least in part of cementitious material. In some variations, the first and second ends of the cylindrical body are, respectively, nose and tail ends of the cylindrical body. Moreover, the exterior cylindrical surface tapers into a tip at the nose end, and the tip is configured to penetrate an underwater floor.

11 Claims, 16 Drawing Sheets

(56) References Cited

U.S. PATENT DOCUMENTS

| | | | | |
|---|---|---|---|---|
| 3,946,695 | A | 3/1976 | Isaak | |
| 4,697,958 | A * | 10/1987 | Kenny, Sr. | B63B 21/28 114/295 |
| 4,781,142 | A | 11/1988 | Cheung | |
| 6,257,166 | B1 | 7/2001 | Lieng | |
| 10,988,909 | B1 | 4/2021 | Cotrell | |
| 2005/0120936 | A1 | 6/2005 | Zimmerman et al. | |
| 2008/0141922 | A1 | 6/2008 | Muehlner | |
| 2014/0053767 | A1* | 2/2014 | O'Loughlin | E02D 5/80 114/295 |
| 2015/0101524 | A1 | 4/2015 | Pence | |
| 2017/0225784 | A1 | 8/2017 | Hayes et al. | |

FOREIGN PATENT DOCUMENTS

| | | | | |
|---|---|---|---|---|
| CN | 106005263 B | * | 11/2017 | B63B 21/243 |
| CN | 108860473 A | * | 11/2018 | B63B 21/24 |
| CN | 108860475 A | * | 11/2018 | B63B 21/26 |
| CN | 108891533 A | * | 11/2018 | B63B 21/48 |
| CN | 108925480 A | * | 12/2018 | A01K 61/65 |
| CN | 209008819 U | * | 6/2019 | B63B 21/24 |
| CN | 209096952 U | * | 7/2019 | B63B 21/24 |
| CN | 211646359 U | * | 10/2020 | |
| CN | 211948377 U | * | 11/2020 | |
| CN | 112078728 | | 12/2020 | |
| CN | 112092980 A | * | 12/2020 | B63B 21/30 |
| CN | 114701601 A | * | 7/2022 | |
| CN | 114813348 A | * | 7/2022 | |
| GB | 2354276 A | * | 3/2001 | E02D 5/385 |
| GB | 2529109 A | * | 2/2016 | B63B 21/26 |
| WO | 2020176262 | | 9/2020 | |

OTHER PUBLICATIONS

English Translated document for CN 211646359 (Year: 2020).*
English Translation of CN 112092980 (Year: 2020).*
English Translation of CN 106005263 (Year: 2017).*
English Translation of CN 106005262 (Year: 2016).*
"Power and Energy Solutions", On the fly, Ask the Experts, https://pes.eu.com/wp-content/uploads/2022/11/PES-W-4-22-Airflight.pdf, 2022, 4 pages.
Delp Mooring , "Torpedo Piles", https://anchortecsolutions.com/torpedo-piles/, 3 pages.
Henriques, Carlos , et al., "Albacora Leste Field Development—FPSO P-50 Mooring System Concept and Installation", Offshore Technology Conference, 18243, May 2006, Dec. 11, 2020, 11 pages.
Volocopter , "VoloDrone—next level logistics", Our heavy-lift solution, https://www.volocopter.com/en/solutions/volodrone, 2023, 11 pages.
Wikipedia , "Offshore embedded anchors", https://en.wikipedia.org/w/index.php?title=Offshore_embedded_anchors&oldid=1077539261, Mar. 16, 2022, 9 pgs.
WIPO, International Search Report and Written Opinion issued in Application No. PCT/US2023/083643 on Apr. 29, 2024, 18 pages.
Delp Mooring , "Torpedo Piles", https://anchortecsolutions.com/torpedo-piles/, website accessed Mar. 1, 2024 (range table at end of 3-page document publicly available on Internet as early as at least Dec. 12, 2022), 3 pages.

* cited by examiner

EMBEDDING ANCHORS IN AN UNDERWATER FLOOR

CROSS-REFERENCE TO RELATED APPLICATIONS

This application claims priority to U.S. Prov. App. No. 63/387,054, which was filed on Dec. 12, 2022 and entitled "Embedding Anchors in an Underwater Floor." This application also claims priority to U.S. Prov. App. No. 63/486,661, which was filed on Feb. 23, 2023 and also entitled "Embedding Anchors in an Underwater Floor." The disclosure of the priority applications are hereby incorporated by reference in their entirety.

BACKGROUND

The following description relates to embedding anchors in an underwater floor.

Mooring and anchoring play an important role in the development of reliable and low-cost floating structures that are capable of remaining fixed in position while floating on water. Examples of floating structures that can benefit from robust anchors include floating offshore wind (FOW) energy systems and floating photovoltaics (FPV) energy systems. The FOW and FPV industries, in particular, may require a variety of anchor types that depend upon seabed conditions, mooring configurations, floating platform types, load capacities, and water depths.

DETAILED DESCRIPTION

In a general aspect, anchors are described for securing structures to an underwater floor. The anchors may be configured as torpedo anchors, and the structures may be floating structures. However, other types of structures are possible (e.g., submersible structures, underwater structures, etc.). The floating structures may, for example, be renewable energy structures such as floating solar systems, wave energy systems, and wind energy systems in freshwater or saltwater bodies of water (e.g., inland or offshore). The anchors can allow these floating systems to be secured more cost effectively than conventional anchors and use fewer and lower carbon intensive materials. The anchors may also facilitate the use of regionally available materials as well as localized manufacturing, both of which may increase local economic benefits. In some implementations, the anchors are configured to secure floating systems with mooring loads ranging from about 2 tons to about 2000 tons of holding capacity.

Figure 1A:
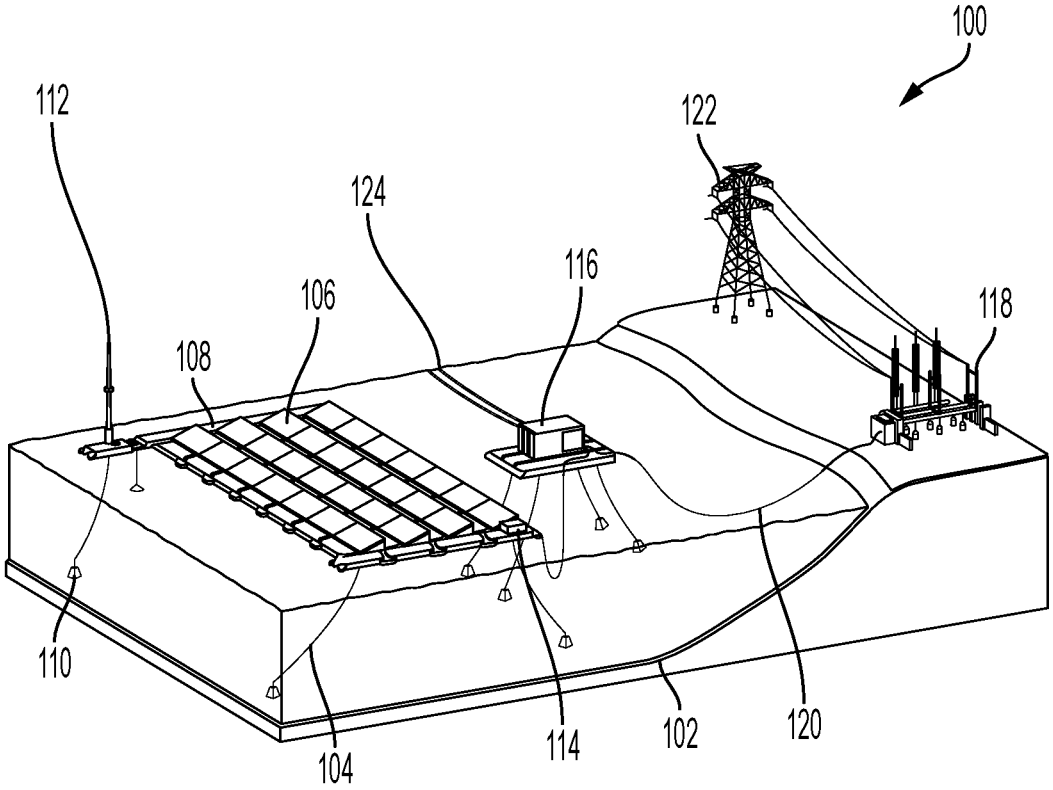
FIG. 1A is a schematic diagram, in perspective view, of an example floating photovoltaic (FPV) energy system anchored to an underwater floor by mooring lines.

In some implementations, the anchors may be used to secure floating photovoltaic (FPV) energy systems to an underwater floor. FPV energy systems are capable of affixing photovoltaic (PV) panels to floating pontoons that are kept in place by mooring lines connected to anchors. FIG. 1A presents a schematic diagram, in perspective view, of an example FPV energy system 100 anchored to an underwater floor 102 by mooring lines 104. Deploying PV panels on bodies of water creates opportunities for solar where ground-mount or rooftop systems are limited or infeasible. FPV energy systems may affix PV panels to floating pontoons kept in place by mooring lines connected to anchors embedded in an underwater floor, such as shown in FIG. 1A. Siting PV panels on shallow and deep bodies of water creates opportunities for solar energy generation where ground-mount or rooftop systems are limited or infeasible (or floating wind turbines are not economically competitive).

In some implementations, the example FPV energy system 100 includes a plurality of PV modules 106, which may be disposed on floats or pontoons 108. The floats or pontoons 108 may, in turn, be secured to the underwater floor 102, such as by the mooring lines 104 that connect the floats or pontoons 108 to anchors 110 on the underwater floor 102. In some variations, such as shown in FIG. 1A, a lightning protection system 112 provides grounding for metal PV module mounting hardware of the example FPV energy system 100. Moreover, a combiner box 114 may be electrically coupled to the plurality of PV modules 106 to combine the electrical power from multiple PV modules 106 (e.g., two or more rows of PV modules 106). The example FPV energy system 100 may also include a central inverter 116 that electrically couples the plurality of PV modules 106 to a transformer 118, such as via an electrical cable (e.g., cable 120, which may be underwater at least in part). The transformer 118 may be electrically coupled to a transmission tower 122. The central inverter 116 may be floating or shore-based, and in certain cases, may be electrically coupled to other floating solar PV arrays, such as via an additional electrical cable 124.

Figure 1B:
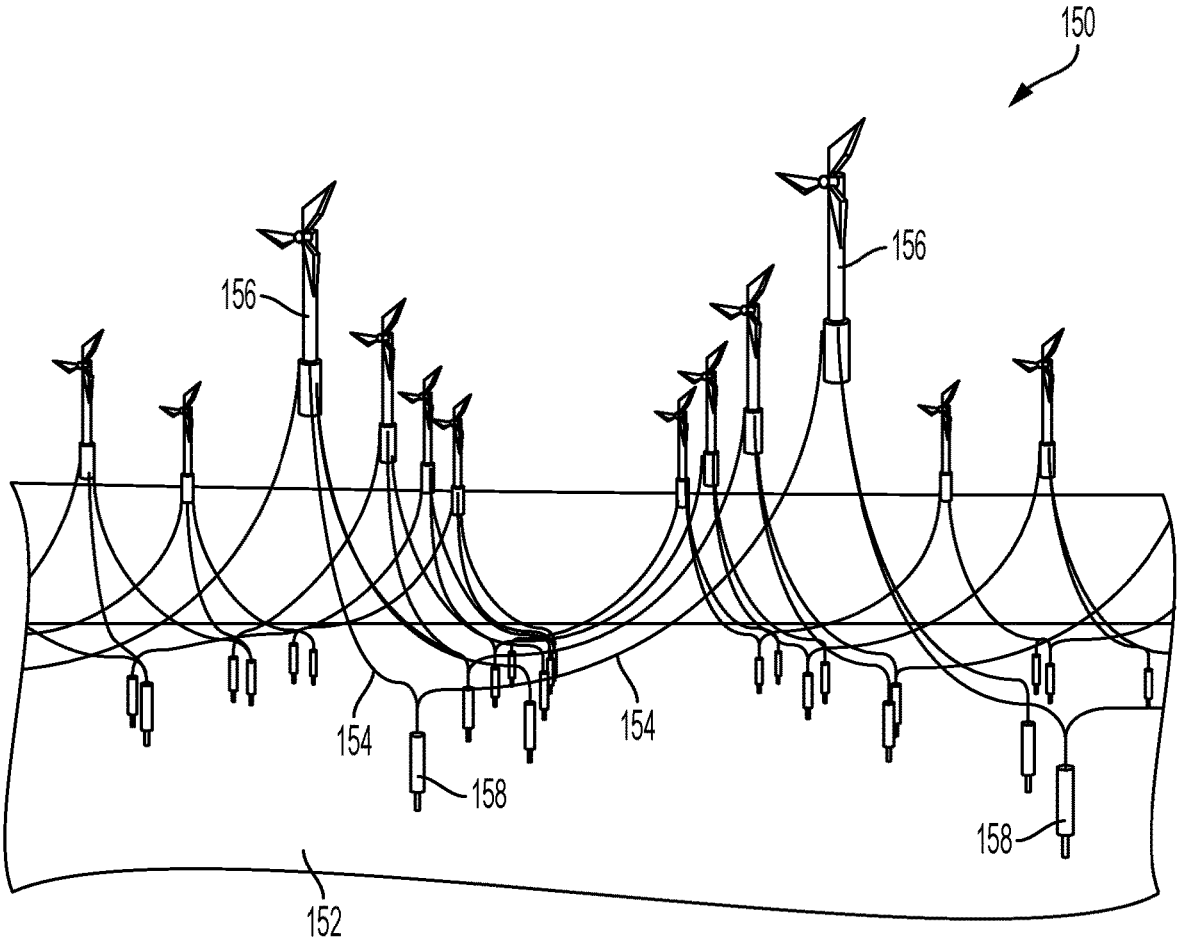
FIG. 1B is a schematic diagram, in perspective view, of an example floating offshore wind (FOW) energy system anchored to an underwater floor by mooring lines.

In these implementations, the anchors 110 may be designed for a smaller load capacity than for a floating offshore wind (FOW) energy system, which can require a large number of anchors per MW of installed power generating capacity. For example, an FOW energy system can require up to 1 anchor per every 5 MW of installed power generating capacity compared to 1 anchor per every 0.03 MW for an FPV energy system. For these reasons, an FPV energy system may need many low-cost anchors with smaller load capacities (e.g., 3 to 30 tons) that can be mass manufactured. In contrast, an FOW energy system may need much larger anchors with a holding capacity from about 1000 tons to about 2000 tons. FIG. 1B presents a schematic diagram, in perspective view, of an example FOW energy system 150 anchored to an underwater floor 152 by mooring lines 154. The example FOW energy system 150 may include a plurality of floating wind turbines 156 secured to the underwater floor 102 by anchors 158. The anchors 158 of FIG. 1B may be configured for a greater holding capacity than the anchors 110 of FIG. 1A.

In a general aspect, the anchors described herein may be configured to be embedded in an underwater floor, such as via impact after free-falling in water. The anchors may rely on kinetic energy that is accrued during free-fall as their velocity increases (e.g., in response to gravity pulling the anchors towards the underwater floor). As such, the anchors may be referred to as "torpedo" anchors or kinetic impact anchors.

Figure 2A:
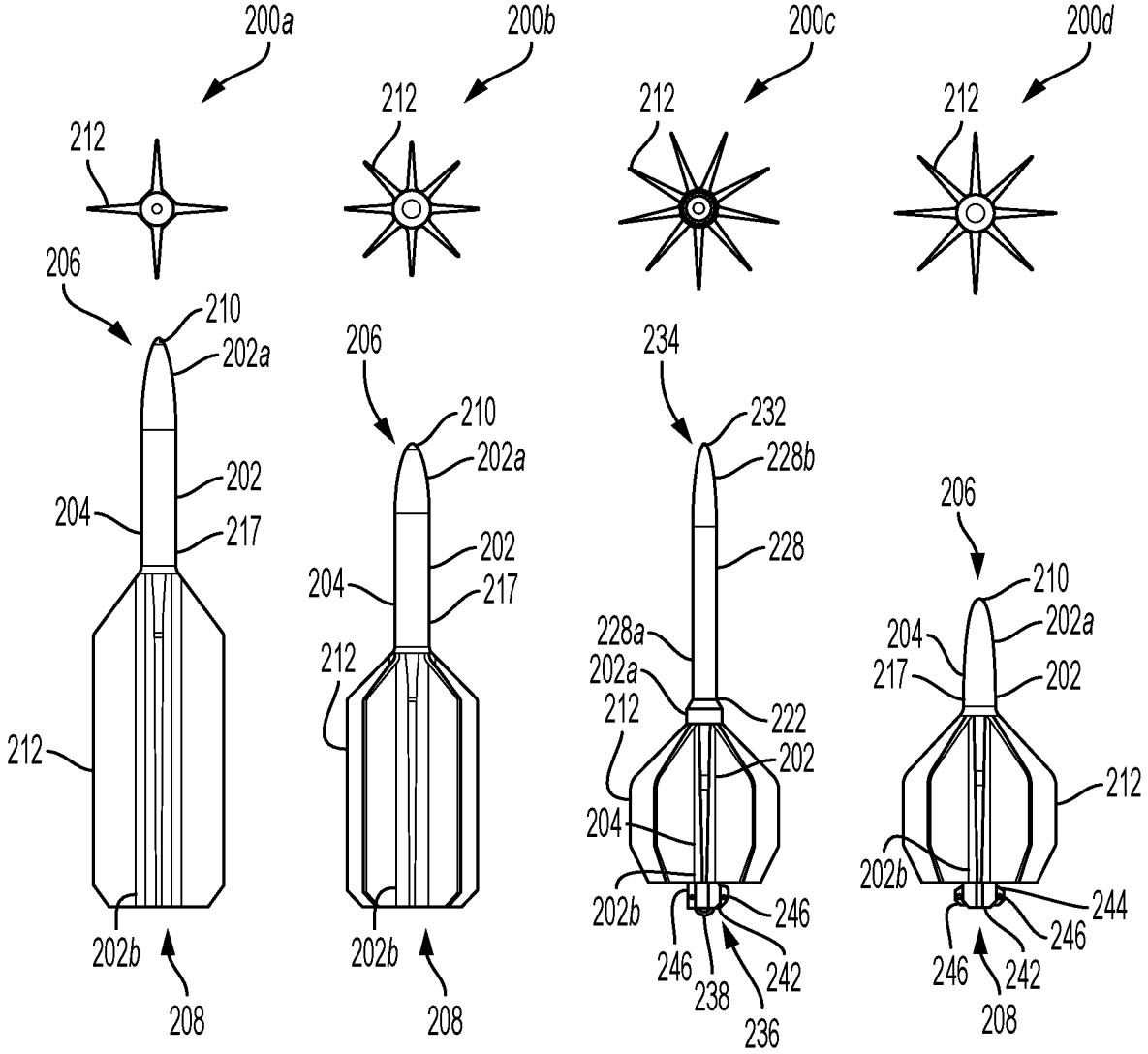
FIG. 2A is schematic diagram of four example torpedo anchors, with upper and lower portions showing, respectively, the top and side views of each example torpedo anchor.
Figure 2B:
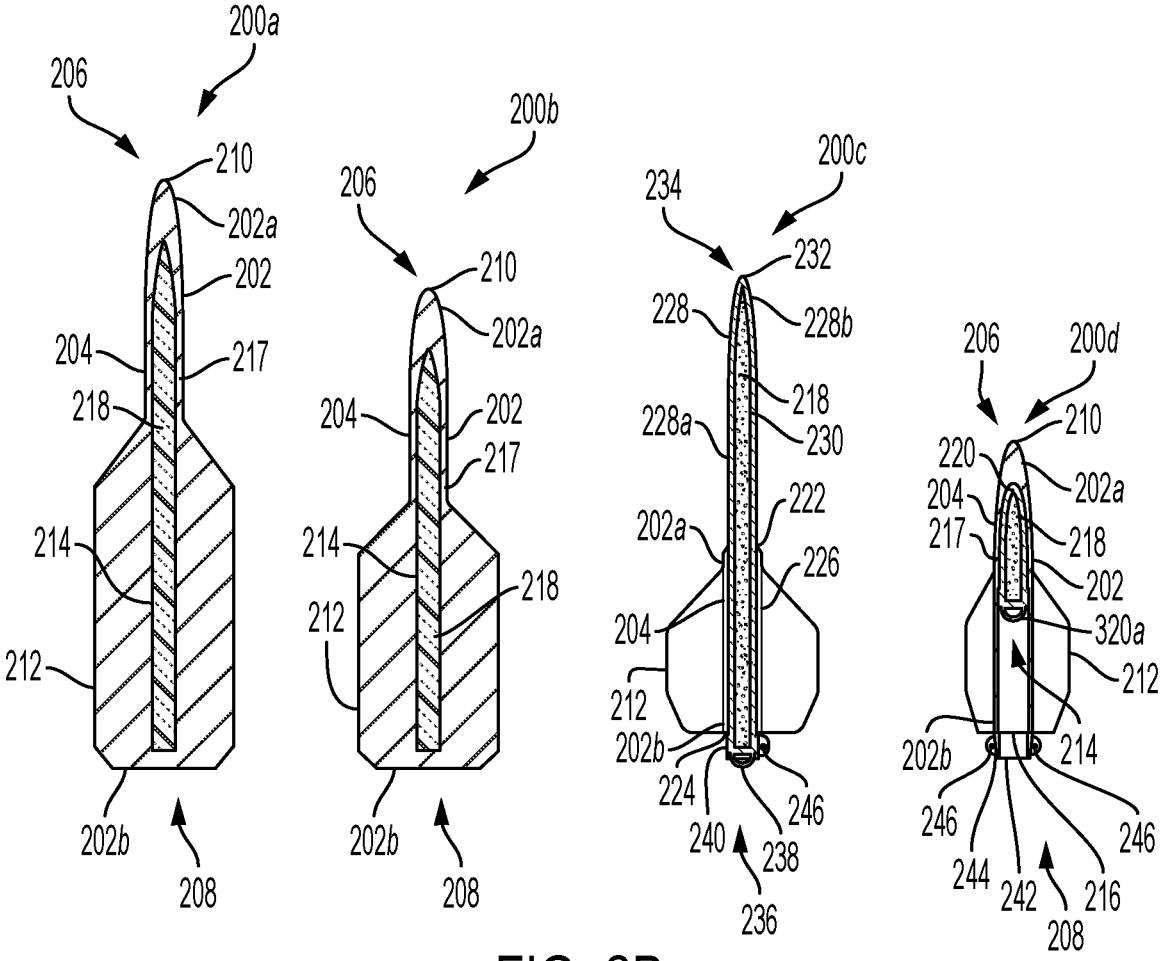
FIG. 2B is a schematic diagram showing the cross-section of each of the four example torpedo anchors of FIG. 2A.

FIG. 2A presents a schematic diagram of four example torpedo anchors 200*a-d*, with upper and lower portions showing, respectively, the top and side views of each example torpedo anchor 200*a-d*. FIG. 2B presents a schematic diagram showing the cross section of each of the four example torpedo anchors 200*a-d* of FIG. 2A. The four example torpedo anchors 200*a-d* may be formed, at least in part, of cementitious material as described further below. The cementitious material may include cement and aggregate (e.g., sand or gravel), and in some variations, may also include reinforcing elements, such as fibers (e.g., steel fibers, polymer fibers, basalt fibers, glass fibers, etc.), rebar (e.g., steel rebar, basalt rebar, etc.), mesh (e.g., steel mesh, fiber mesh, etc.), cables, tendons, staples, and so forth.

The example torpedo anchors 200 include a cylindrical body 202 that has first and second ends 202*a*, 202*b* and an exterior cylindrical surface 204. The cylindrical body 202 may include a portion that includes a pad eye, such as for coupling to a mooring line. The portion may be formed of cementitious material or a metal or metal alloy (e.g., steel). In FIGS. 2A-2B, the example torpedo anchors 200*a*, 200*b* are depicted without pad eyes for purposes of clarity. The first and second ends 202*a*, 202*b* may define, respectively, nose and tail ends 206, 208 of the cylindrical body 202. For example, the exterior cylindrical surface 204 may taper into a tip 210 at the nose end 206, and the tip 210 is configured to penetrate an underwater floor. The tip 210 may have a shape, such as a conical shape, an elliptical shape, a parabolic shape, or some other shape. As another example, the exterior cylindrical surface 204 may taper an outer diameter of the cylindrical body 202 at the tail end 208. If the cylindrical body 202 includes the portion having a pad eye, the portion may be disposed at the tail end 208 of the cylindrical body 202. However, other locations are possible. In some variations, the exterior cylindrical surface 204 includes a patterned surface (e.g., a smooth surface, a patterned surface of dimples, etc.) that is configured to reduce a drag of a torpedo anchor through water. In many variations, the nose and tail ends 206, 208 serve as nose and tail ends of the torpedo anchor 200.

The example torpedo anchors 200 also include a plurality of fins 212 (e.g., a radial array of fins) disposed proximate the second end 202*b* and extending outward from the exterior cylindrical surface 204. Each fin 212 may be formed at least in part of cementitious material. In some implementations, each fin 212 extends along the cylindrical body 202 at least half a length of the cylindrical body 202 (e.g., as shown with example torpedo anchor 200*a*). In some implementations, the plurality of fins 212 defines an outer diameter for the example torpedo anchor that is at least twice an outer diameter of the cylindrical body 202 (e.g. as shown with example torpedo anchor 200*d*).

Figure 3A:
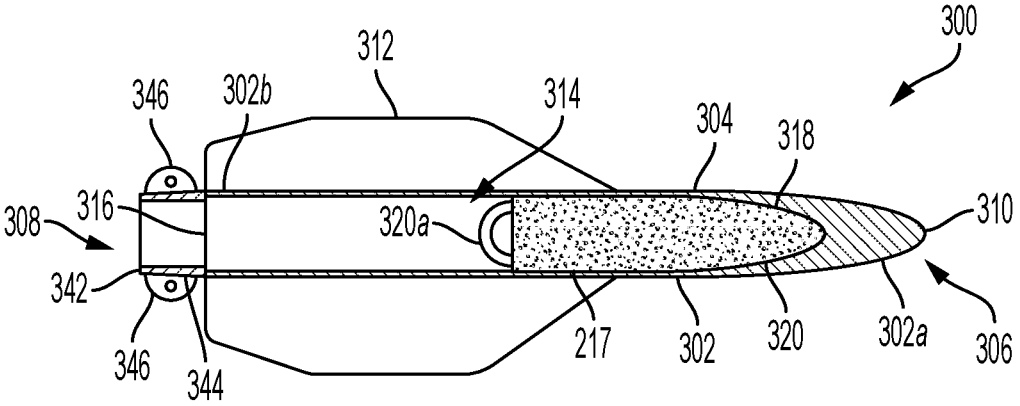
FIG. 3A is a schematic diagram, in cross-section view, of an example torpedo anchor having an interior cavity and a retrievable ballast disposed therein.
Figure 3B:
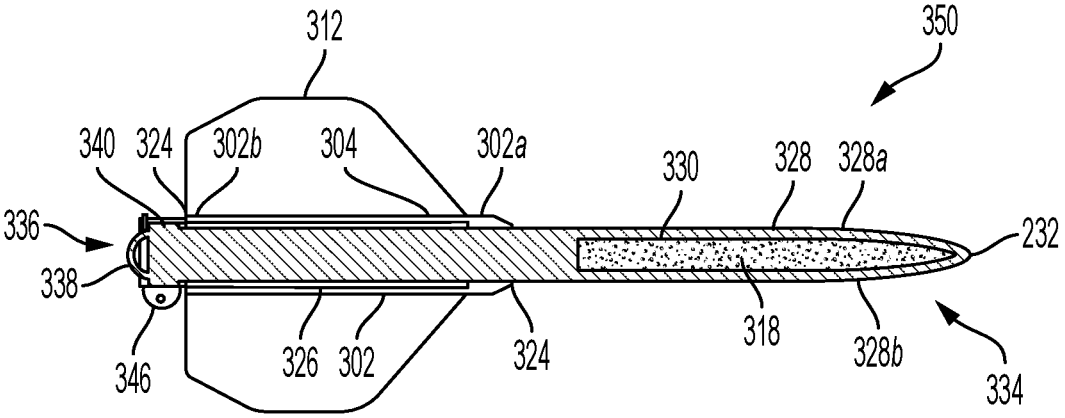
FIG. 3B is a schematic diagram, in cross-section view, of an example torpedo anchor having a shaft disposed through a conduit of a cylindrical body.
Figure 3C:
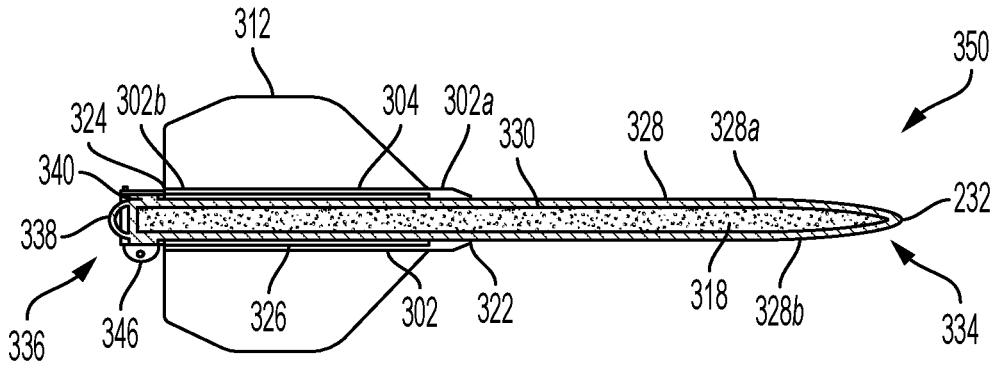
FIG. 3C is a schematic diagram, in cross-section view, of the example torpedo anchor of FIG. 3B but in which the shaft incorporates ballast that extends between the ends of the shaft.
Figure 3D:
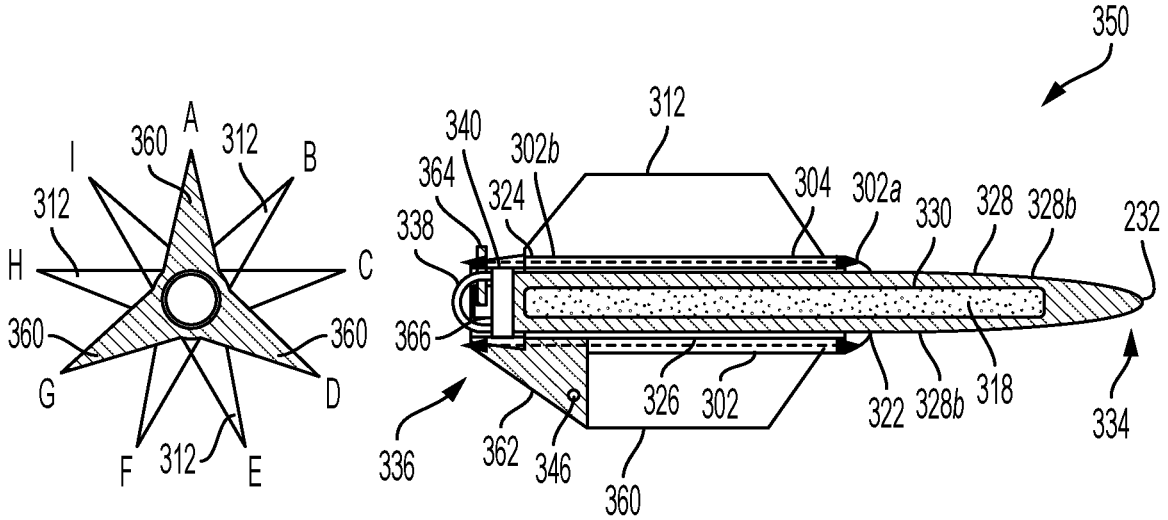
FIG. 3D is a schematic diagram, in rear and cross-section views, of the example torpedo anchor of FIG. 3C, but in which three fins include respective portions formed of metal or a metal alloy.

In some implementations, at least one of the plurality of fins 212 includes a portion that is formed of metal or a metal alloy (e.g., see FIG. 3D). The portion may include a pad eye, such as for coupling to a mooring line. In some implementations, at least one of the plurality of fins 212 includes a base portion that is adjacent to the exterior cylindrical surface 204. In these implementations, a thickness of the at least one fin 212 tapers along a direction away from the base portion. In some implementations, at least one of the plurality of fins 212 includes leading and trailing edges that face towards, respectively, the first and second ends 202*a*, 202*b* of the cylindrical body 202. The leading edge may include a rounded edge. In such implementations, a thickness of the at least one fin 212 tapers along a direction from the leading edge to the trailing edge. In some implementations, at least one of the plurality of fins 212 has an extension length along the cylindrical body 202 that follows a curved pathway. Such a configuration may allow a torpedo anchor to rotate about its cylindrical body 202 (or longitudinal axis thereof) in response to the at least one fin 212 contacting one or both of the body of water or an underwater floor during deployment.

In some implementations, the cylindrical body 202 includes an interior cavity 214 that extends from the tail end 208 towards the nose end 206 (e.g., as shown with example torpedo anchors 200*a*, 200*b*, and 200*d*). In some instances, the tail end 208 includes an opening 216 to the interior cavity 214 (e.g., as shown with example torpedo anchor 200*d*). In these implementations, the cylindrical body 202 also includes a tubular wall 217 formed of cementitious material and encircling the interior cavity 214. The tubular wall 217 includes the exterior cylindrical surface 204.

In some implementations, the example torpedo anchors 200 include ballast 218 disposed in the interior cavity 214. The ballast 218 may be sourced from materials that are close to (e.g., local) to a deployment site, such as a site where a torpedo anchor is loaded onto a vessel for transport to a target location over water. In some variations, the ballast 218 is formed of cementitious material. In some variations, the ballast 218 is formed of material having a density greater than that of cementitious material (e.g., steel, lead, a mixture of concrete and steel, etc.). In some variations, the ballast 218 is part of (e.g., interior to) a retrievable ballast 220 (e.g., a "booster") that can be removed after a torpedo anchor has been deployed into an underground floor, such as shown with example torpedo anchor 200*d*. The retrievable ballast 220 may, in certain cases, include a pad eye 220*a*. The pad eye 220*a* may allow the retrievable ballast 220 to be retrieved, and in certain cases, may also allow the retrievable ballast 220 to couple to a mooring line, such as when anchoring structures to an underwater floor.

In some implementations, the interior cavity 214 extends through the cylindrical body 202 between the first and second ends 202*a*, 202*b* (e.g., as shown with example torpedo anchor 200*c*). The first and second ends 202*a*, 202*b* include respective openings 222, 224 to the interior cavity 214, and the interior cavity 214 defines a conduit 226 that is configured to contain a shaft 228. The shaft 228 may include a hollow portion 230 and ballast 218 that is disposed in the hollow portion 230. In some implementations, the exterior cylindrical surface 204 tapers an outer diameter of the cylindrical body 202 at one or both of the first and second ends 202*a*, 202*b*. In some implementations, such as shown in FIGS. 2A and 2B, the shaft 228 is disposed through the conduit 226 and includes a shaft wall 228*a* that is formed of a metal or metal alloy (e.g., steel). The shaft wall 228*a* defines an exterior shaft surface 228*b* that tapers in into a tip 232 at a nose end 234 of the shaft 228. Moreover, the tip 232 is configured to penetrate an underwater floor. The tip 232 may have a shape, such as a conical shape, an elliptical shape, a parabolic shape, or some other shape. A tail end 236 of the shaft 228 resides proximate the second end 202*b* of the cylindrical body 202. In some implementations, the shaft 228 includes a pad eye 238.

In some implementations, the shaft 228 includes an annular protrusion 240 (e.g., a shoulder) from the exterior shaft surface 228*b* that is located proximate the tail end 236 of the shaft 228. The annular protrusion 240 may have an outer diameter that is larger than an inner diameter of the conduit 226. As such, the annular protrusion may prevent the shaft 228 from sliding completely through the conduit 226 when being inserted therein. In some implementations, the example torpedo anchors 200 (e.g., example torpedo anchor 200*c*) may include an annular collar 242 that is coupled to the second end of cylindrical body and aligned therewith. The annular collar 242 may be configured to allow the example torpedo anchors 200 to selectively lock and unlock the shaft 228 in place. Such selective locking and unlocking is described further in relation to FIG. 3D.

In some implementations, the example torpedo anchors 200 include an annular collar 242 coupled to the second end 202*b* of cylindrical body 202 and aligned therewith. The annular collar 242 may be formed a metal or metal alloy. However, in some variations, the annular collar 242 may be formed, at least in part, of cementitious material. The annular collar 242 may include an exterior circumferential surface 244 that is configured to extend the exterior cylindrical surface 204 of cylindrical body 202. The annular collar 242 may also include a pad eye 246 that extends outward from the exterior circumferential surface 244 and formed of a metal or metal alloy. The annular collar 242 and the pad eye 246 define an integral body. In some variations, the exterior circumferential surface 244 tapers an outer diameter of the annular collar 242 along a direction away from the second end 202*b* of the cylindrical body 202.

FIG. 3A presents a schematic diagram, in cross-section view, of an example torpedo anchor 300 having an interior cavity 314 and a retrievable ballast 320 disposed therein. The example torpedo anchor 300 may be analogous to the example torpedo anchor 200*d* described in relation to FIGS. 2A-2B. Moreover, features analogous to both FIGS. 2A-2B and 3A are related via coordinated numerals that differ in increment by one hundred. The example torpedo anchor 300 may rely upon the pad eye 320*a* or the pad eyes 346 of the annular collar 342 to support loads, such as when coupled to mooring lines. However, unlike the pad eyes 346 of the annular collar 342, the pad eye 320*a* of the retrievable ballast 320 is internal to the interior cavity 314. In certain cases, the pad eye 320*a* may also allow the retrievable ballast 320 to be removed from the interior cavity 314, such as after the example torpedo anchor 300 has been installed, allowing it to be reused for another anchor installation.

FIG. 3B presents a schematic diagram, in cross-section view, of an example torpedo anchor 350 having a shaft 328 disposed through a conduit 336 of a cylindrical body 302. The example torpedo anchor 350 may be analogous to the example torpedo anchor 200*c* described in relation to FIGS. 2A-2B. Moreover, features analogous to both FIGS. 2A-2B and 3A are related via coordinated numerals that differ in increment by one hundred. The example torpedo anchor 300 includes a hollow portion 330 whose cavity is biased towards the nose end 334 of the shaft 328. As such, ballast 318 disposed in the hollow portion 330 may shift a center of gravity of the example torpedo anchor 350, especially if the ballast 318 is formed of a dense material. This configuration of the example torpedo anchor 350 may increase its stability when passing through water. The configuration may also allow the example torpedo anchor 350 to embed deeper into an underwater floor.

FIG. 3C presents a schematic diagram, in cross-section view, of the example torpedo anchor 350 of FIG. 3B but in which the shaft 328 incorporates ballast 328 that extends between the ends of the shaft 328. By occupying a greater volume, the ballast 328 may allow the example torpedo anchor 350 to have a greater mass, thereby allowing the example torpedo anchor 350 to achieve a greater free-fall velocity in water.

FIG. 3D presents a schematic diagram, in rear and cross-section views, the example torpedo anchor 350 of FIG. 3C, but in which three fins 360 include respective portions 362 formed of metal or a metal alloy. The portions 362 are each configured to include a pad eye 338. The example torpedo anchor 350 of FIG. 3D includes the annular collar 342, and the shaft 328 includes the annular protrusion 340. The annular protrusion 340 sits adjacent to the second end 302*b* of the cylindrical body 302. For example, the annular protrusion 340 may be seated against the second end 302*b* of the cylindrical body 302 or an inner surface of the annular collar 342. The example torpedo anchor 350 includes a shear pin 364 that is positioned at the tail end 336 of the shaft 328. The shear pin 364 is operable to hold the annular protrusion 340 adjacent the second end 302*b*, thereby holding the shaft 328 in place in the conduit 326. In doing so, the shear pin 364 may prevent motion of the shaft 328 (or allow minor motion of the shaft 328) relative to the cylindrical body 302. In some variations, such as shown in FIG. 3D, the example torpedo anchor 350 also includes an actuator 366 coupled to the shear pin 364. The actuator 366 is configured to selectively displace the shear pin 364 between an extended position and a retracted position. In the extended position, the shaft 328 is locked in place in the conduit 326. In the retracted position, the shaft 328 is unlocked and thereby free to move within the conduit 326 (e.g., removed from the conduit 326 entirely).

In a general aspect, torpedo anchors are a promising anchor type for a variety of soil conditions to which FPV and FOW energy systems can be secured. Such conditions may include very deep (e.g., 300 m to 2000 m) waters for FOW Wind Energy Areas (WEAs). The torpedo anchors can provide advantages that include a high omnidirectional load capacity suitable for: [1] all mooring configurations (e.g., catenary, semi-taut, and taut), [2] all mooring-line materials, [3] shared mooring configurations, and [4] shared anchor configurations. Moreover, the torpedo anchors can be installed with high-accuracy relative to a target location and are suitable for a variety of seabed types, including soft clay, hard clay, sand, and striated soils. The anchors can also provide high load capacities in the predominately clay beds that are typical to deep-water WEAs. Furthermore, the torpedo anchors can be installed quickly and quietly. The torpedo anchors do not require the use of large vessels and can resist dislocation due to seismic events. Moreover, the torpedo anchors are configured to scale easily from very small load capacities (e.g., about 2 tons of force from a mooring line) to very large load capacities (e.g., about 2000 tons of force from the mooring line).

Torpedo anchors can be formed in whole or in part of cementitious materials (e.g., concrete, steel-reinforced concrete, etc.), such as through construction methods such as 3D printing, 3D casting, conventional casting, and so forth. The use of cementitious materials can thus allow the anchors to be readily and inexpensively made. However, if formed primarily or entirely of steel, torpedo anchors can be some the most expensive anchors to manufacture. Moreover, they can have a very large carbon footprint, and to reduce their high cost, are often imported from states or countries with low-cost labor. In contrast, the anchors described herein address these challenges by combining low-cost and low-carbon cementitious materials with automated concrete manufacturing methods in nearby ports to provide low-cost, environmentally friendly, concrete-based anchors for deep water WEAs as well as shallow WEAs (e.g., as shallow as 10 m).

The use of cementitious materials in fabricating torpedo anchors can substantially reduce their manufacturing costs and carbon footprint as well as facilitate localized manufacturing. For example, and with reference to the example torpedo anchors 200 of FIGS. 2A-2B, the example torpedo anchors 200*a*, 200*b*, and 200*d* have cylindrical bodies 202 that are formed at least in part of cementitious materials. The example torpedo anchors 200*a*, 200*b*, and 200*d* may include a ballast 218 in an interior cavity 214 that is formed of metal or a metal alloy (e.g., steel), although in some cases, the ballast 218 may also be formed of cementitious materials. However, the example torpedo anchor 200*c* shows a configuration in which an integrated nose and booster (e.g., shaft 228) is disposed through a finned sleeve (e.g., the cylindrical body 202 and fins 212 of example torpedo anchor 200*c*). The finned sleeve is formed of cementitious materials and the integrated nose and booster are formed at least in part of metal or a metal alloy (e.g., steel). The metal or metal alloy may have a density higher greater than that of cementitious materials.

The torpedo anchors 200 incorporate features that include fabrication from cementitious materials (e.g., reinforced concrete materials). In some variations, the torpedo anchors 200 may include a streamlined nose, fins, and aft sections that reduce a drag of the torpedo anchors 200 in order to increase a free-fall velocity. In some variations, the torpedo anchors 200 include thicker fins 212 with airfoil cross sections that can increase free-fall stability and fin strength near the shaft. In some variations, the torpedo anchors 200 may be fabricated using robotically controlled 3D printing to manufacture all or part of an exterior shell (e.g., cylindrical body 202, the plurality of fins 212, etc.). In some variations, the torpedo anchors 200 include more fins 212 to increase pull out load capacity. In some variations, the torpedo anchors 200 can include short (e.g., low aspect ratio) designs to simplify their manufacturing, hoisting, and transport. Other possible features include a retrievable metal ballast in the cylindrical body 202 (e.g., the retrievable ballast 220), which may be referred to as a "booster". Certain configurations of the anchors may include an integrated booster and nose (e.g., the shaft 228), such as shown with example torpedo anchor 200*c*.

In a general aspect, the embedment and load capacity of a torpedo anchor increases with its kinetic energy and can be somewhat independent of soil type. Torpedo anchors can penetrate deeper in soft soils which have lower pullout capacity and may penetrate less in shallow and hard and sandy soils that have higher pullout capacity due to the latter soil's higher shear resistance. Deeper penetrations in hard soils, such as sand or over consolidated clays, may require more kinetic energy. This kinetic energy can be achieved by increasing one or both of a mass and installation velocity of a torpedo anchor, which can serve to increase the kinetic energy before impact in an underwater floor.

The installation velocity may, in certain cases, be limited by the terminal velocity of the anchor. Torpedo anchors are generally released at height above an underwater floor (e.g., about 30 m to 150 m) so that they approach free-fall velocities close to terminal velocity just before impact. Such a deployment maximizes their penetration below the surface, where higher strength soils may exist. The terminal velocity can be increased by using streamlined geometries for the anchor components, such as an elliptical shaped nose, airfoil shaped fins that have a rounded nose and tapered tail, fillets at the interface of the fin and cylindrical body, and tapered aft section of the cylindrical body, shaft, and fins. Airfoil-shaped fins may also increase the anchor stability during installation (e.g., to better resist offsetting forces from underwater currents). Such an increase may result from the airfoil-shaped fins generating lift that creates more restoring force than if the fins are configured straight or flat. A curved geometry of the airfoil-shaped fins can be readily realized through cementitious construction, such as through 3D printing or casting. In contrast, if a steel construction were used, the fabrication of the airfoil-shaped fins would become very expensive. Steel is readily available in flat stock (e.g., plates), but its conversion into a curved geometry requires significant post processing (e.g., CNC milling).

The airfoil-shaped fins can also have axisymmetric geometries (e.g., a curved geometry) to generate lift that imparts a slow rotation to the torpedo anchor during free fall. This slow rotation can help mitigate the effects of unintended aerodynamic forces that may act on components of the airfoil, such as a pad eye that could otherwise cause cumulative errors in tracking. Moreover, in some variations, the fins are shaped to intentionally cause fast rotation of the anchor. The increased rotational inertia of the anchor can improve tracking during free fall.

In FIGS. 2A and 2B, the example torpedo anchor 200*a* may be configured to have a reduced mass because it is manufactured using cementitious material. These materials have a density lower than that of steel. However, because the density of cementitious material is less than steel, the example torpedo anchor 200*a* may include a streamlined geometry to reduce its drag in free-falling in water. The reduced drag results in an increased free-fall velocity that can allow the torpedo anchor to achieve a similar kinetic energy if formed of steel.

Increasing the number or the length of the fins can increase the soil bearing and frictional resistance of a torpedo anchor after installation. This increase may allow for a shorter anchor length to be used while still achieving a comparable load capacity. The 8-fin configuration shown in example torpedo anchor 200*b* is shorter than what might be found with a conventional steel torpedo anchor, but has comparable surface area, mass, and load capacity. Although the example torpedo anchor 200*b* may have more frontal area (which can increase the drag in certain cases), the drag of this anchor can be made similar to a conventional steel torpedo anchor by surface streamlining.

Figure 3E:
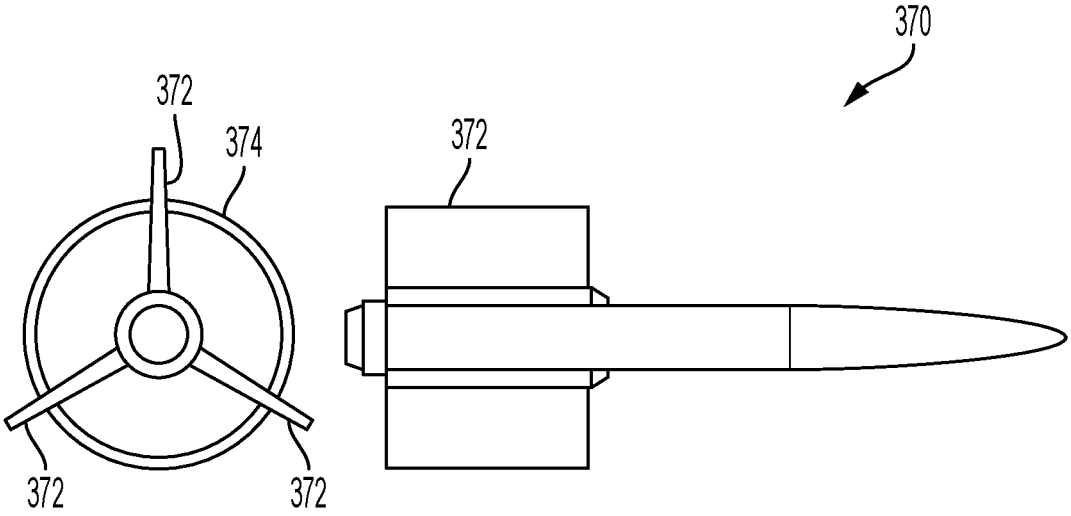
FIG. 3E is a schematic diagram, in rear and cross-section views, of an example torpedo anchor having a plurality of fins that are coupled to each other via a cylindrical ring.

Adding fins to a conventional steel torpedo anchor often requires more welding and manufacturing labor, thereby increasing its cost. However, torpedo anchors formed of cementitious materials, such as the example torpedo anchors 200 described in relation to FIGS. 2A-2D, can use automated manufacturing (e.g., 3D printing) to add fins at little additional cost. A smaller number of fins can also be used, such as three fins. A fin in the shape of a cylindrical ring or linear struts between the fins can also be formed, if desired. For example, FIG. 3E presents a schematic diagram, in rear and cross-section views, of an example torpedo anchor 370 having a plurality of fins 732 (e.g., a radial array of fins) that are coupled to each other via a cylindrical ring 374. The cylindrical ring or linear struts can strengthen the fins by, for example, increasing their bending resistance, increasing their surface area, and increasing the bearing area of the anchor for loads from a mooring line that can occur in various directions.

The example torpedo anchors 200*c*, 200*d* have configurations that can increase the kinetic energy (e.g., both mass and velocity) of the torpedo anchor during free fall, such as by incorporating metal or a metal alloy into their ballast 218. For example, steel or lead ballast—which may be referred to as a "booster"—may be incorporated into the interior cavity 214 of the example torpedo anchors 200*c*, 200*d*. This ballast can be retrieved and reused after installation to reduce cost and embodied carbon. Steel and lead have densities that are, respectively, 3 and 4.5 times higher than concrete. The use of a booster, or what may can be referred to as a "follower", allows advantages that can compensate for the increased design complexity.

The advantages of a removeable booster may include reducing the amount of concrete needed to achieve a high kinetic energy; allowing a length of the anchor to be reduced, if desired, by using more fins; increasing the kinetic energy gained during freefall by increasing a total mass of the torpedo anchor (e.g., by up to 3 times, if desired, for penetrating hard soils); increasing a freefall stability of the anchor by lowering its center of gravity further relative to its center of pressure (e.g., the center of pressure may be the center of area of the anchor and may occur near the center of the fins); allowing for a reduced shaft outer diameter to further increase terminal velocity and decrease soil resistance during penetration; reducing a mass of the torpedo anchor that is hoisted from the underwater floor during retrieval of the torpedo anchor at its end of life; providing a surface on which to locate retrievable instrumentation or measurement systems that provide data and information, such as the anchor installation velocity and position; and potentially expanding the suitable range of installations to shallow water (e.g., as little as 30 m deep water instead of 100 m deep) by reducing the minimum drop height required for penetration. Other advantages are possible.

FIGS. 3A-3E present schematic diagrams of example torpedo anchors 300, 350, 370 that have a finned cylindrical body that is formed at least in part of cementitious material and a booster (e.g., a shaft) disposed through the finned cylindrical body. The booster may have a nose formed of cementitious material, as shown in FIG. 3A, or may have an outer shell formed of a metal or metal alloy (e.g., steel) and be configured to extend through the finned cylindrical body to form the nose, as shown in FIGS. 3B-3E. The configuration of FIG. 3A may reduce the design complexity of the torpedo anchors and may also avoid an impact force on the nose of the anchors after contacting the underwater floor. Combining the booster with the nose of the torpedo anchor, as shown in FIGS. 3B-3E, may assist in realizing the above-referenced advantages. However, other advantages are possible. For example, a booster having a steel nose may impart the ability to create a smoother nose surface finish, thereby reducing skin drag. The steel nose may also reduce the manufacturing complexity of the concrete portion of the anchor by reducing the size of this portion as well as eliminating the need to permanently join concrete parts such as the nose to the shaft. The steel nose may also allow fin assemblies, which may be formed of cementitious material, to be transported separately from the nose, thereby increasing packing density. Such increased packing density may help during storage and transport to or from an installation site. For example, the increased packing and density may reduce the number of trips an installation vessel must make to install or retrieve potentially high numbers of anchors (e.g., hundreds) for a single FOW energy system.

In some variations, the booster is manufactured to have a hardened steel exterior shell for the nose. This shell can minimize damage during embedment of the torpedo anchor, such as from impacting rocks or other materials. In some variations, the boosters, when formed of steel, can be filled with more-dense ballast materials such as lead to further increase the mass of the booster. The center of gravity of the torpedo anchor may also be moved further from the center of pressure. This increased separation may increase anchor stability and tracking during freefall and embedment. The amount of lead can be varied to include a portion of the booster to further move the center of gravity near the nose (e.g., away from the center of pressure), such as shown in FIG. 3B. However, in some cases, the booster may include an interior cavity that extends between the two ends of the booster, such as shown in FIG. 3C. In these cases, the lead occupies the entire interior cavity, thus effectively spanning the entire length of the booster to maximize ballast mass.

During deployment, at the start of embedment, when the nose just touches the underwater floor (but before the fins impact the underwater floor), the booster may be subjected to impact forces from the underwater floor, potentially causing the booster and fins to separate before the fins impact the floor. That is, the booster may decelerate faster than the fins for a period. As shown in FIG. 3D, an actuator (e.g., an electrical servomotor) located on the booster can be used to engage a shear pin that locks the fin assembly to the booster, thus preventing the booster from separating from the fins during handling or during embedment. The actuator is operable to retract the pin after embedment and may be retrieved with the booster for reuse. Other location and methods of temporarily securing the booster to the fin assembly are possible.

After the fins begin to embed, the soil resistance on the fins may become greater than the forces decelerating the booster, thereby causing the booster to drive the finned cylindrical body into the underwater floor. In this case, the larger kinetic energy of the booster will impart forces that embed the fins into the underwater floor. These forces can be efficiently transferred from the booster to the finned cylindrical body through an interface near the aft of the torpedo anchor, such as a shoulder on the booster. A shoulder-type interface can handle large forces in a structurally efficient manner and may also impart compressive forces onto the conduit of the finned cylindrical body. Such compression may be beneficial in cases where the finned cylindrical body (and conduit) is formed of cementitious material.

In many implementations, the torpedo anchors include a pad eye for securing the anchors to a mooring line. A variety of methods can be used to connect the pad eye, which can serve as a connection point for the mooring line or for a shackle, to the torpedo anchor. The pad eye can be located inside the shaft of the anchor (e.g., FIG. 3A), on the tail of the anchor (e.g., FIGS. 3B and 3C), or on a fin (e.g., FIG. 3D). In some variations, the torpedo anchor may include a pad eye connection formed of steel. In this case, the pad eye may allow the torpedo anchor to support very high tensile forces. For example, the pad eye can be formed as a steel weldment or casting that is fastened to the aft portion of the conduit of the finned cylindrical body using post tensioning tendons through the conduit, epoxy, fasteners, or extensions of the sleeve reinforcements such as rebar.

The location of the pad eye can be at or near the shaft axis or at a radial position away from the shaft axis, such as at an extension from the conduit of the finned cylindrical body (e.g., an annular collar) or on a fin. The radial position may be away from the shaft axis to vary the location where the mooring line forces act on the anchor's centroid. Locating the pad eye at a radial position away from the conduit of the finned cylindrical body or on the fins can potentially reduce the rotational forces on the torpedo anchor from the mooring line. The rotational forces may have a component transverse to the shaft axis, thereby increasing the load capacity of the torpedo anchor. In the variation illustrated by FIG. 3D, the pad eye is located at a radial position away from the shaft axis. Moreover, the pad eye is aligned with a fin (e.g., in the wake of the fin) to reduce the hydrodynamic forces and soil resistance force on the pad eye during free-fall and embedment. In these variations, the rear portion of one or more fins can be made of steel and can serve as a pad eye connection. Fabricating the rear portion from steel may provide an added advantage of strengthening the thinnest portion of the fin (relative to a cementitious material).

The torpedo anchors can be manufactured using cementitious materials. The cementitious materials may include concrete and reinforced concrete (e.g., via rebar, fibers, tensioned rods, etc.). The cementitious materials may be processed using one or both of conventional concrete pre-casting and additive manufacturing methods, which may be automated. The additive manufacturing methods include 3D concrete printing (3DCP) or 3D spray printing (3DSP). Conventional concrete pre-casting may be combined with 3D printing to fabricate different components of the torpedo anchor. In some variations, the simple geometries of the torpedo anchors, such as the nose and forward portion of the shaft, can be precast either onsite or near the assembly site. In some variations, the more complex and larger portions of the torpedo anchors (e.g., those with fins) can be 3D printed at or near the assembly site such as at a port. Pre-casting the elliptical nose and finless forward portion of the shaft may reduce the overall height of the printing process and may also reduce drag by creating a smoother surface finish on the most hydrodynamically sensitive portion of the anchor. The more complex finned surfaces may be better suited to additive manufacturing, especially if the number of fins is high, because the acute angles between the fins might otherwise require molds. These molds would be large, complex, heavy, and multi-part, and typically formed of steel. They could also be difficult and expensive to fabricate, assemble, maintain, and store.

In concrete pre-casting, reinforcement materials such as rebar can be placed in a reusable steel formwork and concrete is poured into the steel mold. Alternatively, 3DCP can be used to print a concrete "stay-in-place" formwork in which the reinforcement and concrete materials are placed. The 3DCP formwork bonds with cast materials to become an integral part of the torpedo anchor. If the anchor is manufactured in two parts (e.g., the fins and the forward portion of the shaft), the two pieces can be permanently assembled using grout or by using a standard concrete column design and assembly practice. Compared to conventional concrete casting, 3DCP can makes it easier to incorporate design features that increase load capacity such as 6 or 8 fins. 3DCP can also reduce labor and increase safety using automation and elimination of formwork preparation. Additional benefits include reducing the manufacturing footprint, increasing the production rate, and increasing the scaling to larger sizes by eliminating the cleaning and assembly of large reusable formwork. In certain cases, 3DCP may also incorporate lean manufacturing by facilitating quick design changes. 3CDP may also allow for the manufacturing of different anchor geometries and designs for a FOW energy system (e.g., concrete suction anchors) using the same 3D printer.

For example, in some implementations, a method of manufacturing a torpedo anchor—such as the example torpedo anchors 200 described in relation to FIGS. 2A-2B—includes displacing a flowable cementitious material to form the cylindrical body 202 and the plurality of fins 212. The method also includes hardening the flowable cementitious material into a solidified cementitious material. In implementations where the cylindrical body 202 includes the tubular wall 217 (e.g., example torpedo anchors 200*a*, 200*b*, and 200*d*), the method includes disposing the ballast 218 into the interior cavity 214 after the flowable cementitious material has hardened into the solidified cementitious material. In implementations where the interior cavity 214 defines the conduit 226 (e.g., example torpedo anchor 200*c*), the method includes disposing the shaft 228 through the conduit 226.

In some implementations, displacing a flowable cementitious material includes depositing layers of the flowable cementitious material on top of each other to form the cylindrical body 202 and the plurality of fins 212. For example, the layers of flowable cementitious material may be deposited using an additive manufacturing process, such as 3D concrete printing, concrete spraying, and so forth. Combinations of such processes are possible. In some implementations, the method includes disposing reinforcing elements into the flowable cementitious material before displacing the flowable cementitious material. Examples of the reinforcing elements include fibers (e.g., steel fibers, polymer fibers, basalt fibers, glass fibers, etc.), rebar (e.g., steel rebar, basalt rebar, etc.), mesh (e.g., steel mesh, fiber mesh, etc.), cables, tendons, and staples. In some implementations, displacing a flowable cementitious material includes casting a flowable cementitious material into a formwork that defines a surface of the cylindrical body and the plurality of fins. Such displacing may, in certain cases, include depositing layers of the flowable cementitious material on top of each other to form a wall of the formwork. Reinforcing elements may be positioned in the formwork before casting the flowable cementitious material.

Figure 4A:
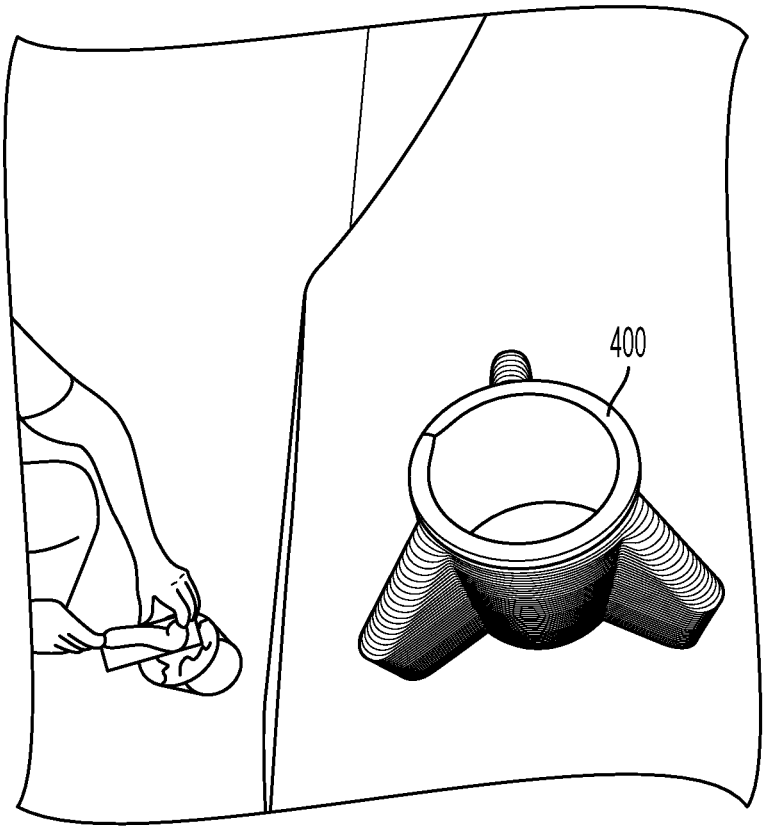
FIG. 4A is an image of an example finned cylindrical body that was fabricated using a 3D concrete printing (3DCP) process.
Figure 4B:
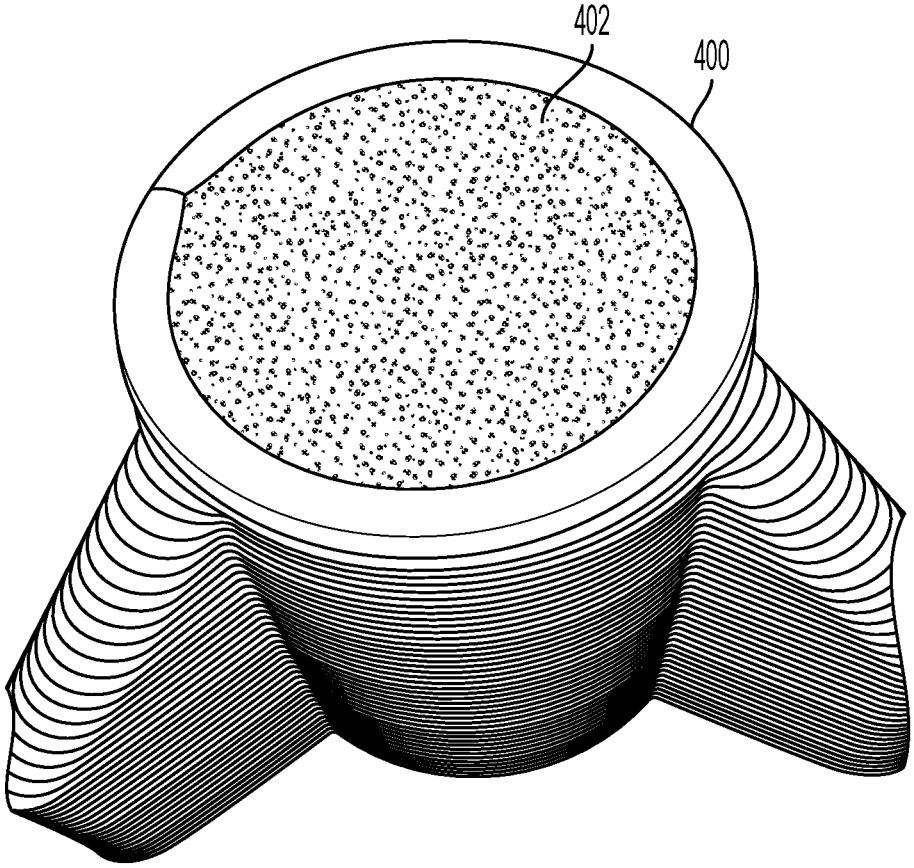
FIG. 4B is an image of the example cylindrical body of FIG. 4A, but in which a conduit of the example cylindrical body has been filled with cementitious material.

FIG. 4A presents an image of an example finned cylindrical body 400 that was fabricated using a 3DCP process. In particular, the fabrication uses stay-in-place formwork that can also incorporate reinforcement materials (e.g., rebar, fibers, etc.) into the fins and conduit of the sleeve before concrete is poured into the conduit to fill the sleeve. FIG. 4B presents an image of the example finned sleeve of FIG. 4A, but in which a conduit of the finned cylindrical body 400 has been filled with a cementitious material 402 (e.g., concrete). The cementitious material 402 may serve as ballast. Alternatively, if the conduit is left unfilled, a booster can be inserted into the example finned cylindrical body 400.

The torpedo anchors may also be formed at least in part of cast materials that include as cementitious materials, castable aluminum materials, castable iron materials, and so forth. For example, in some implementations, a torpedo anchor may include a cylindrical body formed of a cast material and having an exterior cylindrical surface that tapers into a tip at a nose end of the cylindrical body. The exterior cylindrical surface also tapers into an outer diameter of the cylindrical body at a tail end of the cylindrical body. The tip is configured to penetrate an underwater floor. The torpedo anchor also includes a plurality of fins disposed proximate the tail end and extending outward from the exterior cylindrical surface. Each fin is formed at least in part of the cast material and includes a base portion adjacent the exterior cylindrical surface. Moreover, each fin has a thickness that tapers along a direction away from the base portion. In some variations, the cast material is a cast cementitious material. In some variations, the cast material is a cast aluminum material (e.g., a cast material based on aluminum or an alloy of aluminum). In some variations, the cast material is a cast iron material (e.g., a cast material based on iron or an alloy of iron). In many implementations, the torpedo anchor has features that are analogous to those described in relation to the example torpedo anchors 200*a-d* of FIGS. 2A-2D and the example torpedo anchors 300, 350, 370 of FIGS. 3A-3E.

The torpedo anchor may be manufactured using a method that includes disposing a castable material into a formwork or mold that defines a surface of the torpedo anchor. The method also includes solidifying the castable material in the formwork or mold to form a solidified body that defines at least part of the torpedo anchor. The solidified body includes the surface. In many implementations, the method includes removing the formwork or mold from the solidified body. In some implementations, the castable material is a flowable cementitious material. In these implementations, disposing a castable material includes casting the flowable cementitious material into the formwork or mold that defines the surface of the torpedo anchor. In some implementations, the castable material is a molten metal material. In such implementations, the method includes heating a metal material to form the molten metal material. The metal material may be an aluminum material or an iron material. However, other metal materials are possible.

In some implementations, the cylindrical body includes an interior cavity that extends from the tail end towards the nose end. The tail end includes an opening to the interior cavity. The cylindrical body also includes a tubular wall that encircles the interior cavity and includes the exterior cylindrical surface. In these variations, the solidified body may define all of the torpedo anchor. As such, the method may include disposing ballast into the interior cavity.

Figure 5A:
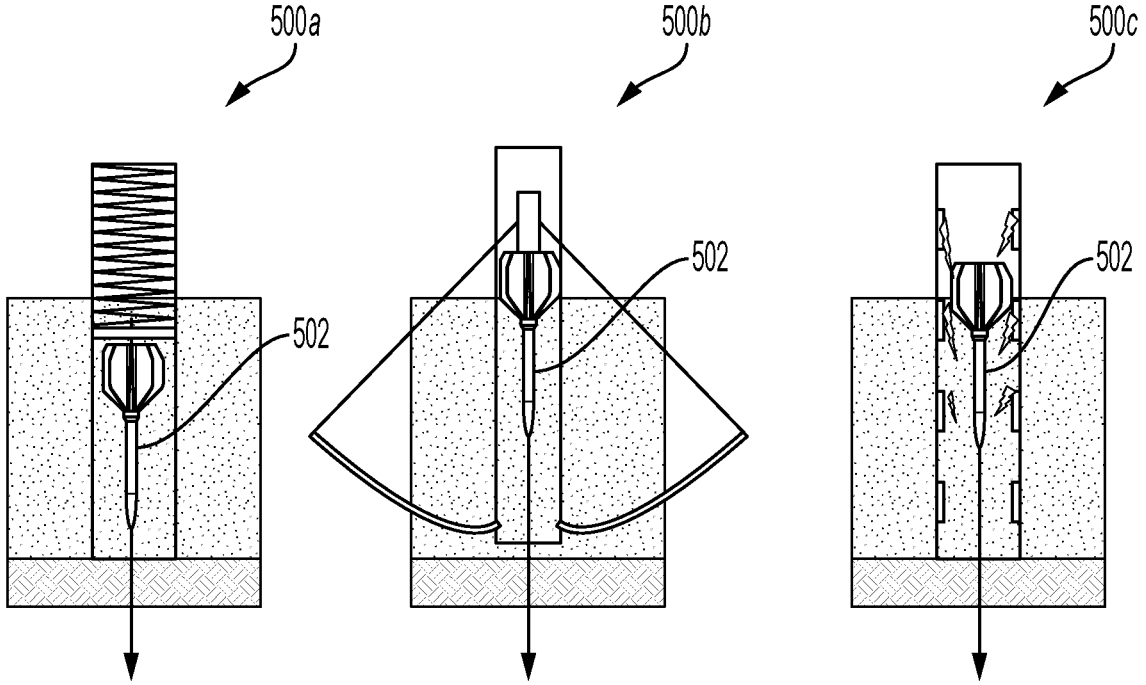
FIG. 5A is a schematic diagram, in elevation view, of three example propulsion methods for embedding a torpedo anchor into an underwater floor using a supplemental means of propulsion.
Figure 5B:
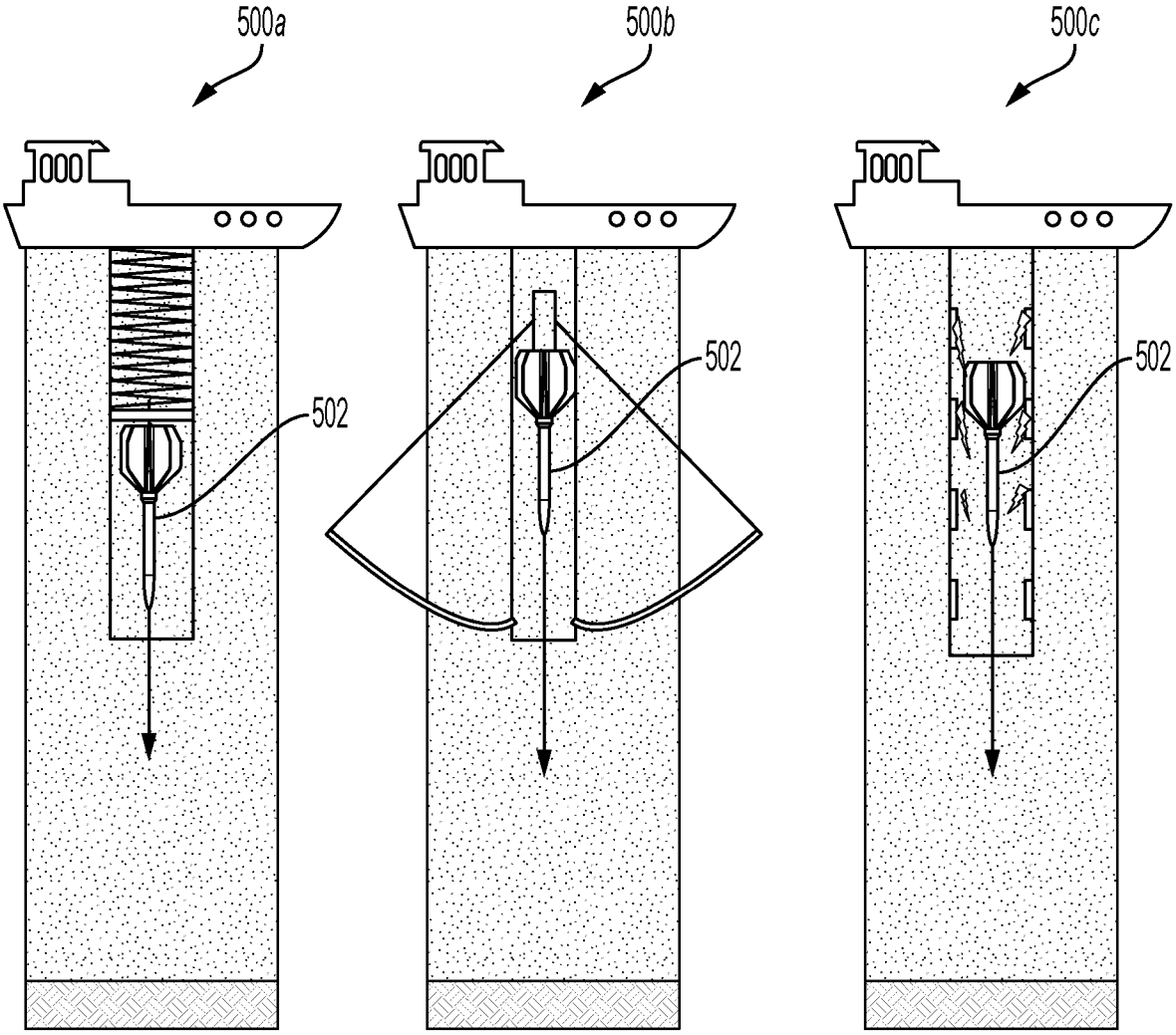
FIG. 5B is a schematic diagram, in elevation view, of the example propulsion methods of FIG. 5A, but in which the supplementation means for propulsion is mounted on a floating vessel.

The torpedo anchors may be installed using a method that accelerates the anchor velocity via propulsion. FIGS. 5A and 5B present schematic diagrams, in elevation view, of example methods for embedding a torpedo anchor into an underwater floor using a supplemental means of propulsion. These methods may, for example, assist the embedment of torpedo anchors when being installed at shallower depths. Torpedo anchors can require sufficient mass and height to reach a velocity to sufficient to penetrate the underwater floor. The methods illustrated in FIGS. 5A-5B can accelerate the torpedo anchors in place of, or combination with, free-fall acceleration to allow their installation at a shallow depth. The methods also allow anchors with a smaller footprint to be used. The methods could also allow lighter anchors to be utilized that do not rely solely on acceleration from gravity. The method of installation may involve one of many means of propulsion such as a catapult or ballista, rail gun, compressed air, spring hammer, and so forth. For example, FIG. 5A presents a schematic diagram, in elevation view, of three example propulsion methods 500*a-c* for embedding a torpedo anchor 502 into an underwater floor using a supplemental means of propulsion. The example propulsions methods 500*a-c* are based on, respectively, a spring hammer, a catapult or ballista, and a rail gun. In some variations, such as shown in FIG. 5B, the means of propulsion are mounted to a floating vessel, such as a barge or launching vessel. The means may or may not require submersion before propulsion. In some implementations, such as when using electromagnetic acceleration from a rail gun, the rail gun can act on the embedded metallic elements in the torpedo anchor (e.g., reinforcement in the cementitious material), on a metal booster, or both. In some implementations, a frame or hoisting device is used to increase the height of the anchor above the water surface to increase the height and freefall distance of the anchor. This increased height and free-fall distance may allow the anchor to achieve a higher velocity before impacting an underwater floor.

In general, the torpedo anchors can have features that include: [1] the use of a flowable, lower density cementitious material to fabricate the fins of an anchor, [2] streamlined surfaces based on airfoil cross sections, fin cross sections that are thicker near the shaft, fillets at the fin/shaft interface, and the like, [3] fabrication, in some configurations, entirely from cementitious material, [4] fabrication, in some configurations, at least in part of a castable material, [5] pad eye locations at a radial position that reduces the rotational forces on the anchor when embedded, [6] alignment of the pad eye with one or more fins in the radial direction to reduce drag and embedment forces, [7] the use of a booster integrated with the anchor, [8] the integration of the booster to include the nose, [9] the use of steel endcaps at one or both ends of a finned cylindrical body to help position and secure the booster, the use of post tensioning between the steel endcaps to strengthen the finned cylindrical body, the incorporation of a large number of fins (e.g., more than four) in an anchor to help reduce its overall length while maintaining its load capacity, and the use of a stiffening ring or struts in the fins to increase the bearing load, soil friction, and strength of the fins.

The torpedo anchors can also confer manufacturing features. For example, components of the torpedo anchors (e.g., the cylindrical body, nose, fins, etc.) can be built using concrete pre-casting, 3D printing, 3D casting, or 3D spray processes that aid in the inclusion of reinforcement materials. The 3D casting process, in particular, can allow for the use recycled concrete materials into the mix or use of large low cost and small carbon footprint aggregates (e.g., up to ¾" in diameter). Such aggregates may otherwise be difficult to print or spray through a small hose or nozzle. As another example, the anchor shell (e.g., a stay form) may be manufactured at an offsite printing facility. Such manufacturing allows for the shipment of a lighter weight anchor assembly that can be filled with locally sourced ballast materials close to the installation site. As another example, the components of the torpedo anchors can also be built, at least in part, of a castable material, such as a cementitious material, a castable aluminum material, a castable iron material, and so forth.

The torpedo anchors can additionally provide competitive advantages over anchors fabricated entirely (or nearly entirely) of steel. For example, the torpedo anchors include configurations formed of cementitious material that can have reduced costs compared to a steel equivalent by approximately 90% and embodied carbon by 95%. Moreover, the use of a retrievable booster can reduce the quantity of materials needed for the embedded anchor, and in particular, the materials needed for the fins of each embedded anchor. As such, the production rate for manufacturing the anchors may increase. As another example, the booster may be configured to integrate the nose of the anchor, thereby allowing the transportation of a single booster with several fin assemblies to increase the number of anchors transported on a vessel.

Furthermore, the ease of manufacturing afforded by additive manufacturing can allow the fin assembly to have an increased number of fins. This increase may allow the anchor to be designed with a shorter length that eases manufacturing, transportation, hoisting, and storage footprint of the anchor. The use of concrete materials and automated manufacturing may also facilitate the use of regionally available materials, thereby increasing local economic benefits and reducing transportation costs. In some variations, the anchors may be manufactured using robotically placed concrete. Such robotic placement can improve the alignment of the fins, thereby increasing the stability and tracking of an anchor after penetration in the underwater floor. The lower density of concrete fins, and the higher density of the booster, may help move the center of gravity of the anchor towards the nose and away from the center of pressure. This displacement may increase the anchor's stability and tracking.

In general, torpedo anchors may be a type of pile-type anchor. Pile-type anchors can perform and install very well in predominately clay soils and well in hard soils and striated seabeds. In contrast, drag and helical-screw anchors have poor load capacity and can be challenging to install in soft clay due to its very low shear stress. The keying of plate anchors (the process of rotating an anchor, or keying, to an angle normal to the mooring line load) and the reliance on torque/tension correlations for helical screw anchors creates large uncertainties in the installation process and loss of embedment for plate anchors. In contrast, the embedment and load capacity of a torpedo anchor are correlated to its kinetic energy and are somewhat independent of soil type. Torpedo anchors can penetrate deeper in soft soils, which have lower pullout capacity, and shallower in hard and sandy soils, which have higher pullout capacity.

Torpedo anchors also have good load efficiencies (e.g., load capacity/anchor dry mass embedded) when compared to their steel counterparts. However, when including a booster, torpedo anchors can have much higher efficiencies due to the low density of concrete and the booster's retrieval after deployment. The booster that includes the nose have a load capacity that is comparable to a dynamically embedded plate anchor (DEPLA). However, torpedo anchors that include boosters do not require keying after embedment due to their large fin area and length. Torpedo anchors also have good resistance to seismic loads because they embed well beneath the seabed, and often below where soil liquification is most severe. Increasing the length or depth of pile-type anchors may be a primary means of mitigating potential anchor movement due to soil liquefaction. But torpedo anchors have potential to be the most earthquake resistant anchor because they embed far beneath the surface. Moreover, a mooring line, when coupled to a torpedo anchor, pulls more vertically at the top of the anchor, mitigating the chance of misalignment when subject to mooring loads in liquified soil. Torpedo anchors may also be less sensitive to misalignment than other anchor types.

In some implementations, the torpedo anchors may be configured to anchor floating solar plants. For a floating solar plant, the torpedo anchors may allow for an innovative, low-cost configuration and installation method for floating photovoltaics (FPV). The torpedo anchors may be manufactured using 3DCP processes, and as such, may reduce FPV balance-of-system costs, boost FPV deployment in the US, and reduce $CO_2$ emissions from FPV anchoring.

Novel manufacturing and installation techniques may be used to flexibly adapt torpedo anchors for FPV. For manufacturing, the use of cementitious materials (e.g., via 3DCP fabrication) and cast metal (e.g., iron, aluminum, etc.) may allow for cost and efficacy. 3DCP of cementitious material (a) enables faster, lower-cost, lower-$CO_2$ construction than welded steel and (b) allows lower-cost optimization of anchor hydrodynamics, given that 3DCP can produce novel complex shapes as easily as simple ones. 3DCP may offer benefits over traditional concrete manufacturing approaches because it eliminates the costly formwork required by traditional concrete casting methods. 3DCP may thus further reduce cost and offer extreme flexibility. However, non-3DCP manufacturing methods for may also be possible. Cast iron or cast aluminum may also be useful for FPV torpedo anchors. Castings in the size range contemplated for FPV application are readily available from commercial foundries and iron has several relevant virtues, as detailed below.

In some implementations, the torpedo anchors may be formed from cast materials. For example, the casting of concrete and iron in smooth forms may allow the torpedo anchor to incorporate hydrodynamic anchor features. In contrast, the welded-steel torpedo anchors used in the oil and gas industry weigh up to 100 tons. FPV arrays generally do not require such large anchors, which opens up the possibility of cast torpedo anchors in certain applications. For example, commercial iron casting of complex shapes up to about 5.4 tons is readily available, which is suitable for many FPV applications. In shallow reservoirs, the mass of a torpedo anchor mass may not need to exceed about 100 kg. Iron has higher density than concrete, which may allow a torpedo anchor formed of iron to have a potentially decisive advantage for embedment. Iron is also recyclable and can be cast directly into a finished complex shape. Iron generally has better rust resistance than steel, and in many cases, is less costly than steel. Iron may also require less energy to form into useful shapes.

3DCP and cast torpedo anchors can be deployed from surface watercraft, but for weights within the lift capabilities of cargo drones such anchors can be advantageously dropped from the air (see FIGS. 6A-6F). Deployment methods based on cargo drones can be effective for dropping the relatively small torpedo anchors that are appropriate for shallow reservoirs. Heavy lift drones, for example, may have cargo capacities up to 400 lb (180 kg) and capacities are increasing.

Figure 6A:
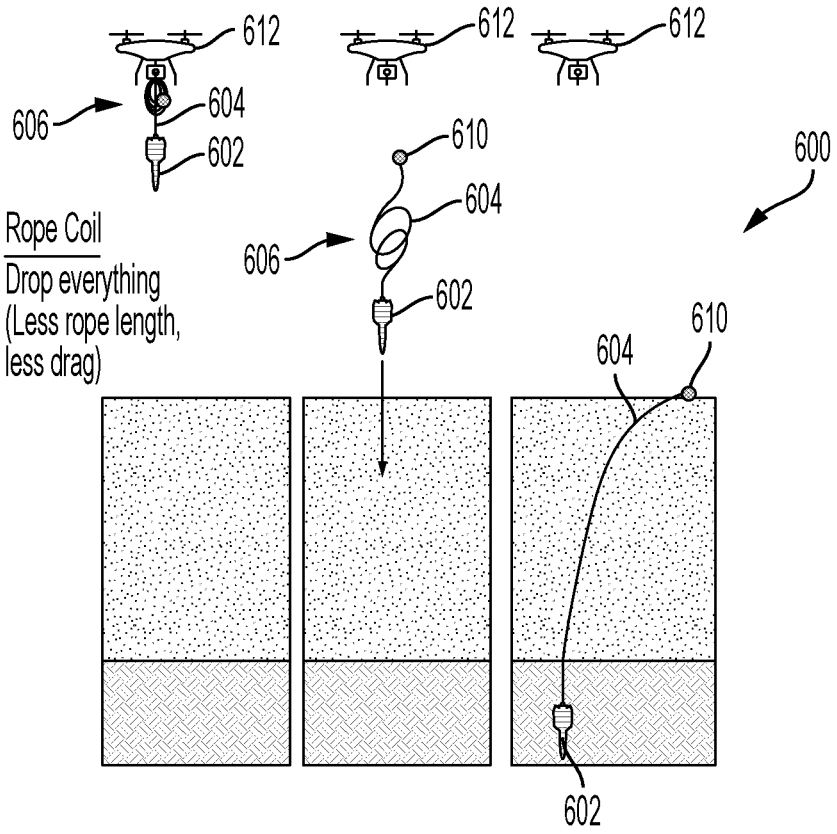
FIG. 6A is a schematic diagram, in elevation view, of an example mooring line arrangement for deploying a torpedo anchor in which a mooring line is contained within a coil.
Figure 6B:
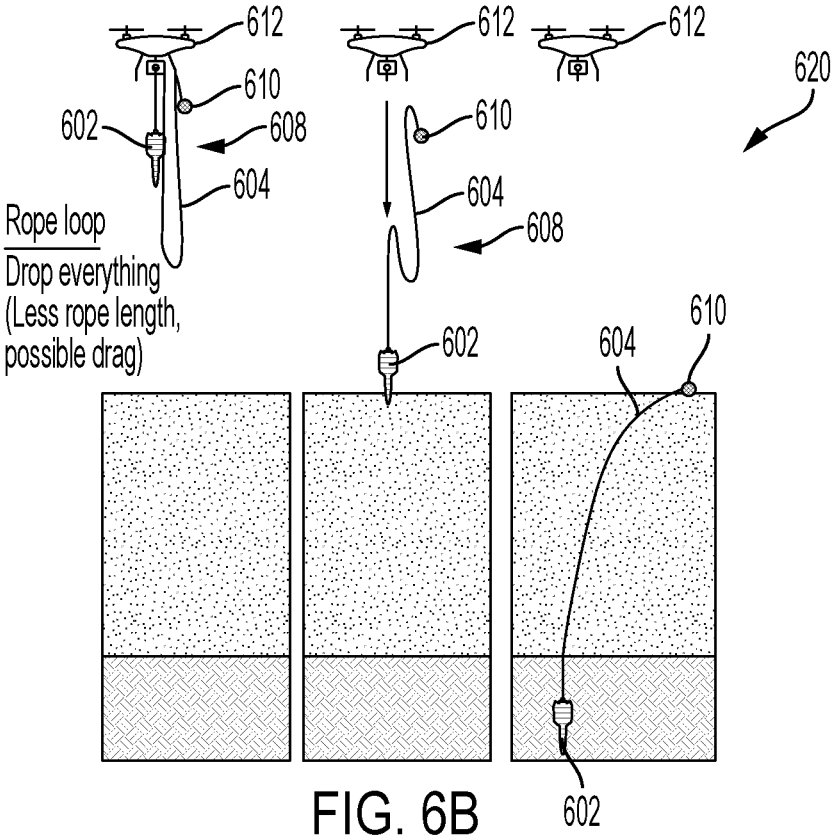
FIG. 6B is a schematic diagram, in elevation view, of an example mooring line arrangement for deploying a torpedo anchor in which a mooring line is contained in a loop.

Connecting mooring line equipment to a torpedo anchor onshore before the anchor is installed may be useful in avoiding the hazards and complexities associated with work on or under the water. Several configurations are possible for connecting the mooring line and anchor assembly to an unmanned aerial vehicle. An example method for connecting a mooring line to a torpedo anchor is illustrated in FIGS. 6A-6B. FIG. 6A presents a schematic diagram, in elevation view, of an example mooring line arrangement 600 for deploying a torpedo anchor 602 in which a mooring line 604 is contained within a coil 606. FIG. 6B presents a schematic diagram, in elevation view, of an example mooring line arrangement 620 for deploying the torpedo anchor 602 in which the mooring line 604 is contained in a loop 608.

The method may include attaching a float 610 near the end of the mooring line 604 to allow easy access to the mooring line 604 after embedment. The method may also include coiling (FIG. 6A) or looping (FIG. 6B) the mooring line 604 and then connecting it to the torpedo anchor 602 onshore before the unmanned aerial vehicle 612 lifts the torpedo anchor 602 and mooring line assembly (e.g., the mooring line 604, the float 610, and the torpedo anchor 602). The torpedo anchor 602 is then deployed by releasing the entire assembly at a specified height. In doing so, the torpedo anchor 602, the mooring line 604, and the float 610 fall due to gravity, with the torpedo anchor 602 accelerating faster than the mooring line 604 and the float 610 due to its larger mass and more aerodynamic profile. Furthermore, the low density and high drag of the float 610 can slow the velocity of the float 610. During fall, the mooring line 604 may uncoil or unloop and straighten due to a difference in velocity between the torpedo anchor 602 and the float 610. The length of the mooring line 604 can be increased, if necessary, so that the float 610 does not resist or slow the fall of the torpedo anchor 602.

Figure 6C:
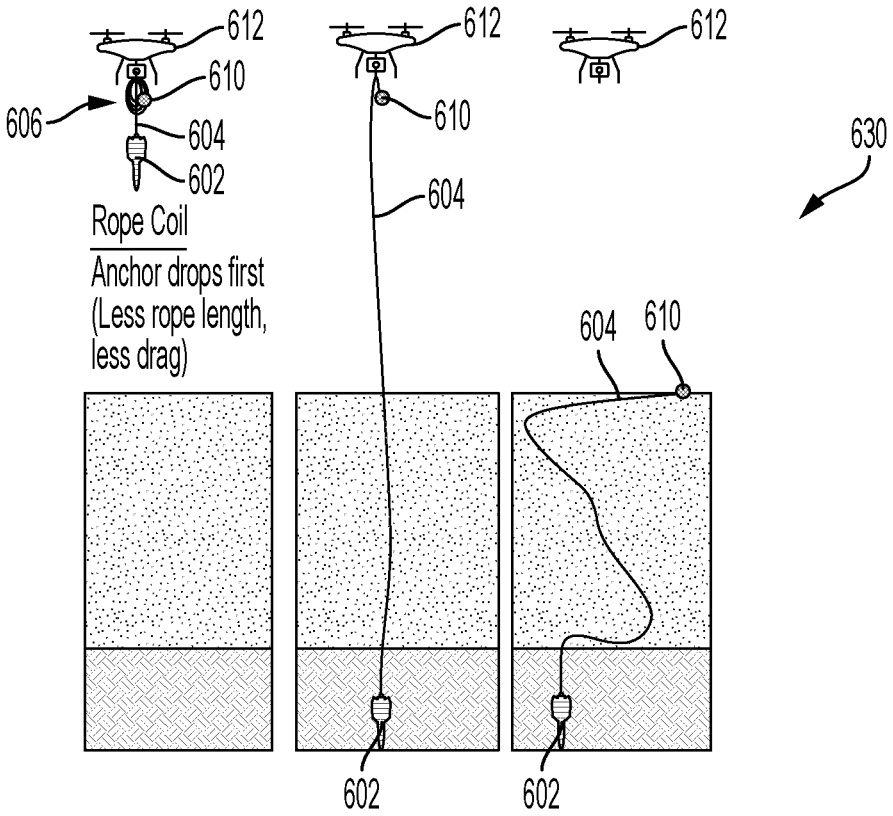
FIG. 6C is a schematic diagram, in elevation view, of an example mooring line arrangement for deploying a torpedo anchor in which a float of a mooring line remains coupled to an unmanned aerial vehicle until after the torpedo anchor embeds in an underwater floor.
Figure 6D:
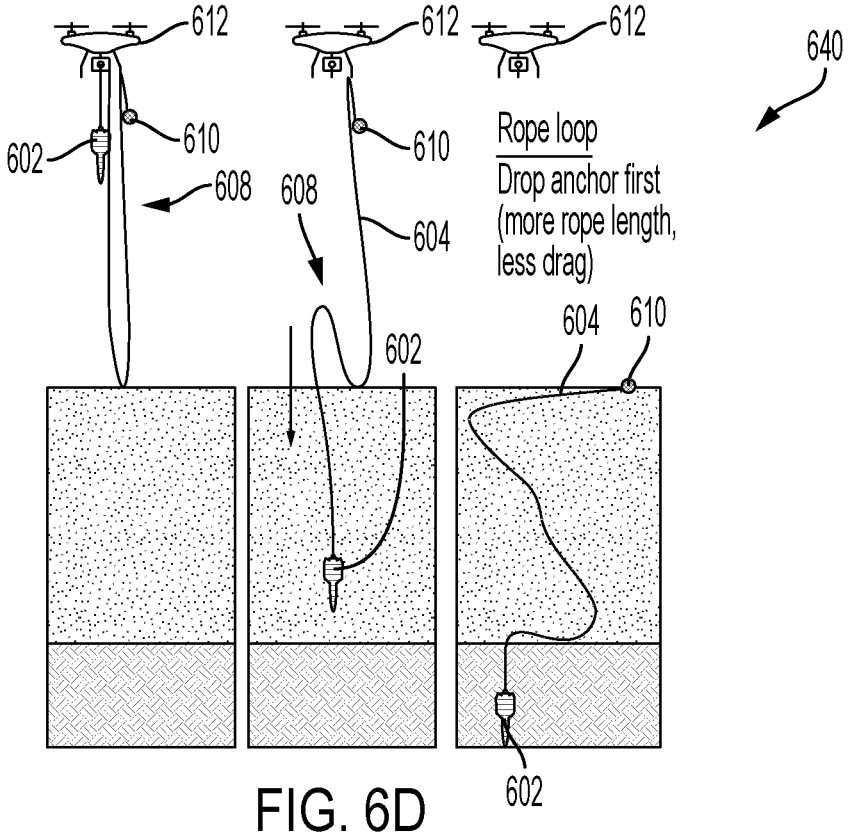
FIG. 6D is a schematic diagram, in elevation view, of an example mooring line arrangement for deploying a torpedo anchor in which a portion of a mooring line remains coupled to an unmanned aerial vehicle until after the torpedo anchor embeds in an underwater floor.
Figure 6E:
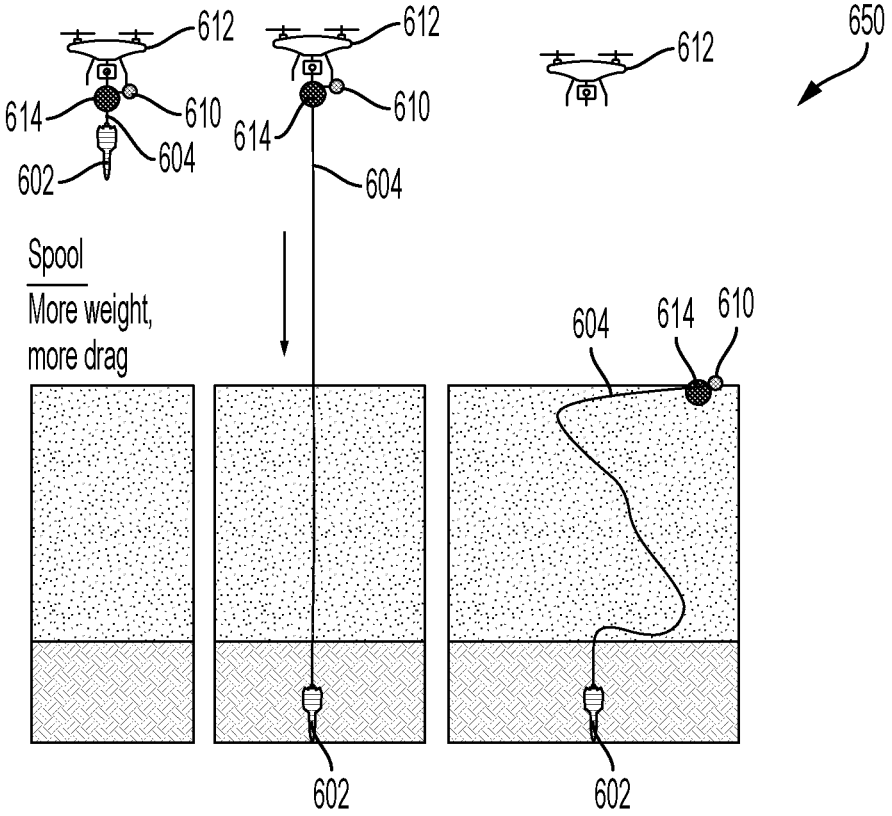
FIG. 6E is a schematic diagram, in elevation view, of an example mooring line arrangement for deploying a torpedo anchor in which a portion of a mooring line, contained in spool as a coil, remains coupled to an unmanned aerial vehicle until after the torpedo anchor embeds in an underwater floor.
Figure 6F:
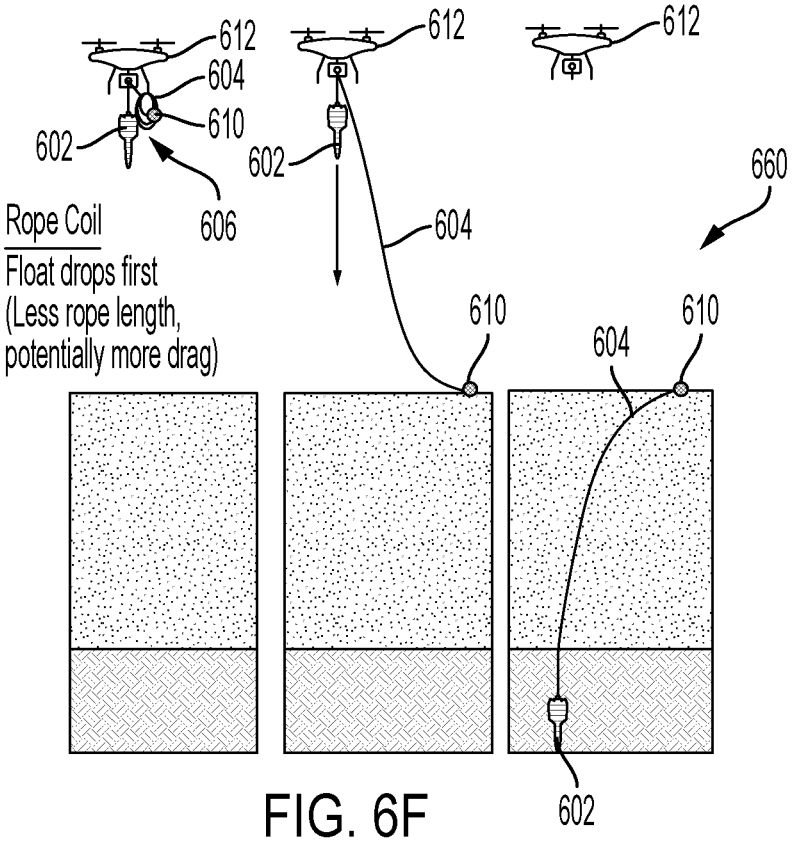
FIG. 6F is a schematic diagram, in elevation view, of an example mooring line arrangement for deploying a torpedo anchor in which a mooring line and a float are released from an unmanned aerial vehicle before the torpedo anchor.

Other configurations of connecting the mooring line and floating to the torpedo anchor are possible, such as shown in FIGS. 6C-6E. For example, the float 610 can remain attached to the unmanned aerial vehicle 612 until after the torpedo anchor 602 embeds to reduce the chance of the coil 606 tangling during freefall, as shown in the example mooring line arrangement 630 of FIG. 6C. As another example, as shown in the example mooring line arrangement 640 of FIG. 6D, a portion of the mooring line 604 (e.g., the loop 608) can remain attached to the unmanned aerial vehicle 612 until after the torpedo anchor 602 embeds. The mooring line 604 can also be coiled around a spool 614 to further reduce the chance of tangling, as shown in the example mooring line arrangement 650 of FIG. 6E. The spool 614 remains attached to the unmanned aerial vehicle 612 until after the torpedo anchor 602 embeds. Alternatively, as shown in the example mooring line arrangement 660 of FIG. 6F, the float 610 and the mooring line 604 may be released before the torpedo anchor 602, which can potentially reduce drag on the torpedo anchor 602 as well as the possibility of tangling the mooring line 604.

Figure 7:
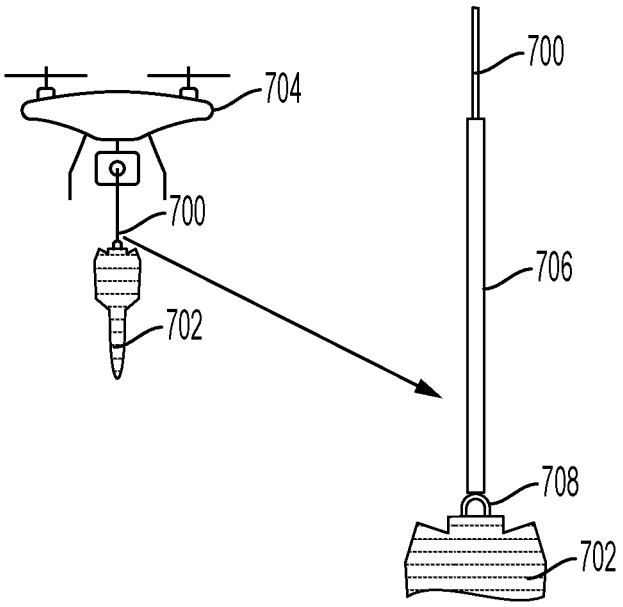
FIG. 7 is a schematic diagram of an example mooring line coupling a torpedo anchor to an unmanned aerial vehicle in which the mooring line includes a protective sheath connected to a pad eye of the torpedo anchor.

In some implementations, the mooring line may be a synthetic rope such as a rope formed of nylon or polyester. Other types of mooring lines, however, are possible (e.g., steel chains or steel wire). Synthetic rope may be beneficial due to its higher strength-to-weight ratio and reduced mass that must be lifted by the unmanned aerial vehicle. Furthermore, the mooring line may include different materials and sections. For example, the portion of the mooring line connected to the anchor that embeds in the ground may be comprised of a wear resistant material such as steel wire. The section may also contain a sheath that protects the line from rocks, sand, or other abrasive material beneath or on the underwater floor. FIG. 7 presents a schematic diagram of an example mooring line 700 coupling a torpedo anchor 702 to an unmanned aerial vehicle 704 in which the mooring line 700 includes a protective sheath 706 connected to a pad eye 708 of the torpedo anchor 702.

In some implementations, the portion of the mooring line that connects to the float may be designed to be used only for retrieval of the line after installation. The portion may also be removed before the mooring line is connected to a structure, such as a FPV float. In certain cases, the portion may be made of a lighter material to reduce the payload of the unmanned aerial vehicle, especially for the mooring installation method illustrated in FIG. 6D, which potentially has very long lengths of mooring line.

The use of an unmanned aerial vehicle (UAV), such as a drone, to deploy torpedo anchors brings multiple advantages, including height, accuracy, speed, and safety. For example, a selective target height can help to ensure sufficient embedment depth. A torpedo anchor should, in general, be falling at its hydrodynamic terminal velocity (in water) when it strikes an underwater floor. In deep water, such a target velocity can be achieved with release the torpedo anchor at or below the surface. However, in shallow water, the target velocity may not be achievable without releasing the torpedo anchor from some target height above the surface. To raise a torpedo anchor significantly above a deck height, a surface vessel would require a crane, entailing a relatively large vessel with commensurate expense. However, an unmanned aerial vehicle can drop a torpedo anchor from virtually any altitude with ease. For sufficiently shallow water and a high drop altitude of hundreds of feet, a UAV-dropped torpedo anchor can even impact the bottom at a speed higher than the torpedo anchor's terminal velocity in water. Such enhanced speed allows for the potential of deep embedment with a lower torpedo anchor mass than would otherwise be required for an equal embedment at lower impact velocity. The selectable target height thus allows installation of torpedo anchors in virtually any water depth.

The selectable target height may also aid in embedding torpedo anchors in soils that are difficult to penetrate, such as compacted sands.

As another example of the advantages that can be provided by a UAV, a drone may include a navigation system (e.g., a GPS system) that allows the UAV to drop a torpedo anchor within inches of its target location, thus providing significant accuracy. A drone may also offer speed in deployment. A drone can potentially grab a torpedo anchor from a truck or staging yard, position, and release the torpedo anchor with much greater rapidity than if the torpedo anchor was fetched from shore for deployment by a surface watercraft. The use of a drone may additionally improve safety. The conventional installation of anchors relies on divers and watercraft with large industrial hoisting and installation equipment. These installation methods often require special safety precautions due to the hazards of deep water. However, UAV-drop methods can perform all work on shore and in a more controlled environment. Such an environment is free from water hazards and is further away from the large industrial equipment.

Figure 8:
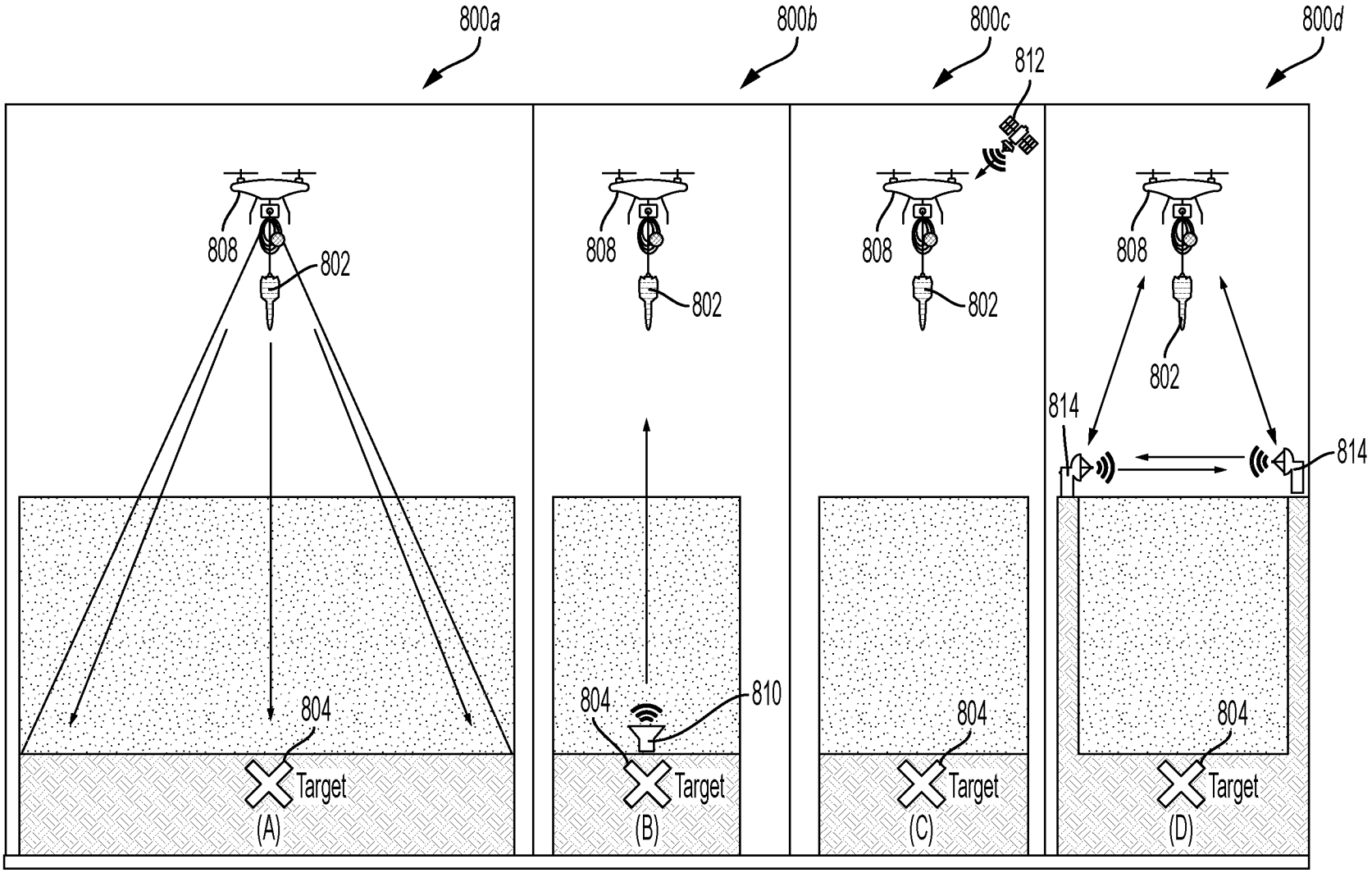
FIG. 8 is a schematic diagram, in elevation view, of four example deployment methods for locating a torpedo anchor over a target on an underwater floor using an unmanned aerial vehicle (UAV).

FIG. 8 presents a schematic diagram, in elevation view, of four example deployment methods 800*a-d* for positioning a torpedo anchor 802 over a target location 804 on an underwater floor 806 using an unmanned aerial vehicle (UAV) 808. An aspect of the four example deployment methods 800*a-d* is the use of various positioning systems (or a combination of systems) to quickly and precisely install the torpedo anchor 802 at a pre-established target location 804. The target location 804 and the UAV location can be quickly and easily identified and communicated via signals to the UAV 808. For example, the example deployment method 808*a* may use laser scanning and sensing processes, such as those provided by a light detection and ranging (LIDAR) system. LIDAR systems use light in the form of a pulsed laser to measure ranges (e.g., variable distances) to the Earth, and as such, be used in remote sensing methods. The LIDAR system can be positioned on the UAV 808 or at a ground-based position for tracking the position of the UAV 808 with respect to the target location 804. As another example, the example deployment method 808*a* may use an optical imaging system on the UAV 808 or at a ground-based position for tracking the position of the UAV 808 with respect to the target location 804. The optical imaging system may, in certain cases, include one or more cameras.

In some variations, such as shown in relation to the example deployment method 808*b*, an acoustic sensing system 810 is used for positioning the torpedo anchor 802 over the target location 804. The acoustic sensing system 810 may include acoustic sensors and horns disposed on one or both of the underwater floor 806 and the UAV 808. In some variations, the UAV 808 includes a navigation system (e.g., a GPS system), such as shown in in relation to the example deployment method 808*c*. The navigation system may be assisted by one or more satellites 812 in positioning the torpedo anchor 802 over the target location 804. In some variations, such as shown in relation to the example deployment method 808*d*, a local positioning system (LPS) is used for positioning the torpedo anchor 802 over the target location 804. The local positioning system may be disposed on the UAV 808 or at a ground-based position. The local positioning system may in certain cases, be configured to triangulates signals from cellular controllers 814 to long-range, long-life, low-cost radio frequency electronic tags on the UAV 808 or the target location 804.

In some implementations, a method of deploying a torpedo anchor includes coupling the torpedo anchor to an unmanned aerial vehicle (UAV) to produce a laden UAV. The torpedo anchor includes a cylindrical body that has nose and tail ends. The cylindrical body also has an exterior cylindrical surface that tapers into a tip at a nose end of the cylindrical body. In many variations, the tip is configured to penetrate an underwater floor. The method also includes moving, by operation of a propulsion system of the UAV, the laden UAV to a target position over a body of water. The method additionally includes releasing the torpedo anchor from the laden UAV, thereby allowing the torpedo anchor to enter the body of water below the target position. In many variations, the target position includes a target height over the body of water. The target height is based on a target terminal velocity for the torpedo anchor to penetrate into an underwater floor below the target position. In some variations, the torpedo anchor includes a plurality of fins disposed proximate the tail end and extending outward from the exterior cylindrical surface. Each fin includes a base portion adjacent the exterior cylindrical surface and a thickness that tapers along a direction away from the base portion.

In some implementations, the torpedo anchor includes a mooring line and a float coupled to an end of the mooring line. In certain instances, a portion of the mooring line is coupled to the UAV (e.g., a loop of the mooring line, a coil of the mooring line in a spool, etc.). In these instances, releasing the torpedo anchor includes releasing the portion of the mooring line from the laden UAV after the torpedo anchor has penetrated an underwater floor below the target location. In certain instances, the float is coupled to the UAV. In such instances, releasing the torpedo anchor includes releasing the float from the laden UAV after the torpedo anchor has penetrated an underwater floor below the target location.

In some implementations, at least one fin has an extension length along the cylindrical body that follows a curved pathway. In these variations, the method includes rotating the torpedo anchor about a longitudinal axis of the cylindrical body in response to the at least one fin contacting one or both of the body of water or an underwater floor.

In some implementations, the UAV includes a locking mechanism that is displaceable between a first position, where the locking mechanism couples the torpedo anchor to the UAV, and a second position, where the locking mechanism uncouples the torpedo anchor from the UAV. The UAV also includes an actuator configured to actuate the locking mechanism from the first position to the second position in response to receiving an unlock signal. The actuator is also configured to actuate the locking mechanism from the second position to the first position in response to receiving a lock signal. The UAV additionally includes a control system in communication with the actuator and configured to generate the lock and unlock signals.

In some aspects of what is described, a torpedo anchor may be described by the following examples. The torpedo anchor is formed at least in part of cementitious material, and in certain cases, is configured to secure floating structures to an underwater floor. However, other types of structures are possible (e.g., submersible structures, underwater structures, etc.).

Example 1. A torpedo anchor, comprising:

a cylindrical body having first and second ends and an exterior cylindrical surface, the cylindrical body formed of cementitious material; and a plurality of fins disposed proximate the second end and extending outward from the exterior cylindrical surface, each fin formed at least in part of cementitious material.

Example 2. The torpedo anchor of example 1,
wherein the first and second ends of the cylindrical body are, respectively, nose and tail ends of the cylindrical body; and
wherein the exterior cylindrical surface tapers into a tip at the nose end, the tip configured to penetrate an underwater floor.

Example 3. The torpedo anchor of example 2, wherein the cylindrical body comprises:
an interior cavity that extends from the tail end towards the nose end, the tail end comprising an opening to the interior cavity; and
a tubular wall formed of cementitious material and encircling the interior cavity, the tubular wall comprising the exterior cylindrical surface.

Example 4. The torpedo anchor of example 3, comprising ballast disposed in the interior cavity.

Example 5. The torpedo anchor of example 2 or any one of examples 3-4, wherein the exterior cylindrical surface tapers an outer diameter of the cylindrical body at the tail end.

Example 6. The torpedo anchor of example 1,
wherein the cylindrical body comprises an interior cavity that extends through the cylindrical body between the first and second ends, the first and second ends comprising respective openings to the interior cavity; and
wherein the interior cavity defines a conduit that is configured to contain a shaft.

Example 7. The torpedo anchor of example 6, wherein the exterior cylindrical surface tapers an outer diameter of the cylindrical body at one or both of the first and second ends.

Example 8. The torpedo anchor of example 6 or example 7, comprising:
the shaft, disposed through the conduit and comprising:
a shaft wall formed of a metal or metal alloy and defining an exterior shaft surface, the exterior shaft surface tapering into a tip at a nose end of the shaft, the tip configured to penetrate an underwater floor;
wherein a tail end of the shaft resides proximate the second end of the cylindrical body.

Example 9. The torpedo anchor of example 8, wherein the shaft comprises ballast disposed in a hollow portion of the shaft.

Example 10. The torpedo anchor of example 8 or example 9, wherein the shaft comprises a pad eye.

Example 11. The torpedo anchor of example 8 or any one of examples 9-10, wherein the shaft comprises an annular protrusion from the exterior shaft surface that is located proximate the tail end of the shaft.

Example 12. The torpedo anchor of example 1 or any one of examples 2-11, wherein the cylindrical body comprises a portion that is formed of metal or a metal alloy, the portion comprising a pad eye.

Example 13. The torpedo anchor of example 12, wherein the portion is disposed at the tail end of the cylindrical body.

Example 14. The torpedo anchor of example 1, wherein at least one fin comprises a portion that is formed of metal or a metal alloy, the portion comprising a pad eye.

Example 15. The torpedo anchor of example 1 or any one of examples 2-14, wherein at least one fin comprises:
a base portion adjacent the exterior cylindrical surface; and
a thickness that tapers along a direction away from the base portion.

Example 16. The torpedo anchor of example 1 or any one of examples 2-15,
wherein at least one fin comprises leading and trailing edges that face towards, respectively, the first and second ends of the cylindrical body; and
wherein a thickness of the at least one fin tapers along a direction from the leading edge to the trailing edge.

Example 17. The torpedo anchor of example 1 or any one of examples 2-16, wherein at least one fin has an extension length along the cylindrical body that follows a curved pathway.

Example 18. The torpedo anchor of example 1 or any one of examples 2-17, wherein each fin extends along the cylindrical body at least half a length of the cylindrical body.

Example 19. The torpedo anchor of example 1 or any one of examples 2-18, wherein the plurality of fins defines an outer diameter for the torpedo anchor that is at least twice an outer diameter of the cylindrical body.

Example 20. The torpedo anchor of example 1 or any one of examples 2-19, wherein the exterior cylindrical surface comprises a patterned surface that is configured to reduce a drag of the torpedo anchor through water.

Example 21. The torpedo anchor of example 1 or any one of examples 2-20, comprising:
an annular collar coupled to the second end of cylindrical body and aligned therewith, the annular collar comprising:
an exterior circumferential surface that is configured to extend the exterior cylindrical surface; and
a pad eye extending outward from the exterior circumferential surface and formed of a metal or metal alloy.

Example 22. The torpedo anchor of example 21, wherein the exterior circumferential surface tapers an outer diameter of the annular collar along a direction away from the second end of the cylindrical body.

In some aspects of what is described, a method of manufacturing a torpedo anchor may be described by the following examples. The torpedo anchor is formed at least in part of cementitious material, and in certain cases, is configured to secure floating structures to an underwater floor. However, other types of structures are possible (e.g., submersible structures, underwater structures, etc.).

Example 23. A method of manufacturing a torpedo anchor, the method comprising:
displacing a flowable cementitious material to form a cylindrical body and a plurality of fins, wherein:
the cylindrical body has first and second ends and an exterior cylindrical surface, and
the plurality of fins is disposed proximate the second end and extends outward from the exterior cylindrical surface, each fin formed at least in part of the flowable cementitious material; and
hardening the flowable cementitious material into a solidified cementitious material.

Example 24. The method of example 23,
wherein the first and second ends of the cylindrical body are, respectively, nose and tail ends of the cylindrical body; and
wherein the exterior cylindrical surface tapers into a tip at the nose end, the tip configured to penetrate an underwater floor.

Example 25. The method of example 24,
wherein the cylindrical body comprises:

an interior cavity that extends from the tail end towards the nose end, the tail end comprising an opening to the interior cavity, and a tubular wall formed of the flowable cementitious material and encircling the interior cavity, the tubular wall comprising the exterior cylindrical surface; and wherein the method comprises disposing ballast into the interior cavity after the flowable cementitious material has hardened into the solidified cementitious material.

Example 26. The method of example 23, wherein the cylindrical body comprises an interior cavity that extends through the cylindrical body between the first and second ends, the first and second ends comprising respective openings to the interior cavity; and wherein the interior cavity defines a conduit that is configured to contain a shaft, the shaft comprising:

a shaft wall formed of a metal or metal alloy and defining an exterior shaft surface, the exterior shaft surface tapering into a tip at a nose end of the shaft, the tip configured to penetrate an underwater floor; and wherein the method comprises disposing the shaft through the conduit.

Example 27. The method of example 26, wherein the shaft comprises ballast disposed in a hollow portion of the shaft.

Example 28. The method of example 23 or any one of examples 24-27, wherein displacing a flowable cementitious material comprises depositing layers of the flowable cementitious material on top of each other to form the cylindrical body and the plurality of fins.

Example 29. The method of example 23 or any one of examples 24-28, comprising:

disposing reinforcing elements into the flowable cementitious material before displacing the flowable cementitious material.

Example 30. The method of example 23, wherein displacing a flowable cementitious material comprises casting a flowable cementitious material into a formwork that defines a surface of the cylindrical body and the plurality of fins.

Example 31. The method of example 30, wherein displacing a flowable cementitious material comprises depositing layers of the flowable cementitious material on top of each other to form a wall of the formwork.

Example 32. The method of example 31, comprising:

positioning reinforcing elements in the formwork before casting the flowable cementitious material.

In some aspects of what is described, a torpedo anchor may be described by the following examples. The torpedo anchor is formed at least in part of cast material, and in certain cases, is configured to secure floating structures to an underwater floor. However, other types of structures are possible (e.g., submersible structures, underwater structures, etc.).

Example 33. A torpedo anchor, comprising:

a cylindrical body formed of a cast material and having an exterior cylindrical surface that:

tapers into a tip at a nose end of the cylindrical body, the tip configured to penetrate an underwater floor, and tapers an outer diameter of the cylindrical body at a tail end of the cylindrical body; and a plurality of fins disposed proximate the tail end and extending outward from the exterior cylindrical surface, each fin formed at least in part of the cast material and comprising:

a base portion adjacent the exterior cylindrical surface; and a thickness that tapers along a direction away from the base portion.

Example 34. The torpedo anchor of example 33, wherein each fin comprises leading and trailing edges that face towards, respectively, the nose and tail ends of the cylindrical body; and wherein the thickness of each fin tapers along a direction from the leading edge to the trailing edge.

Example 35. The torpedo anchor of example 33 or example 34, wherein the cylindrical body comprises:

an interior cavity that extends from the tail end towards the nose end, the tail end comprising an opening to the interior cavity; and a tubular wall formed of the cast material and encircling the interior cavity, the tubular wall comprising the exterior cylindrical surface.

Example 36. The torpedo anchor of example 35, comprising ballast disposed in the interior cavity.

Example 37. The torpedo anchor of example 33 or any one of examples 34-35, wherein the cylindrical body has a portion that comprises a pad eye.

Example 38. The torpedo anchor of example 37, wherein the portion is disposed at the tail end of the cylindrical body.

Example 39. The torpedo anchor of example 33 or any one of examples 34-38, wherein at least one fin has a portion that comprises a pad eye.

Example 40. The torpedo anchor of example 33 or any one of examples 34-39, wherein at least one fin has an extension length along the cylindrical body that follows a curved pathway.

Example 41. The torpedo anchor of example 33 or any one of examples 34-40, wherein each fin extends along the cylindrical body at least half a length of the cylindrical body.

Example 42. The torpedo anchor of example 33 or any one of examples 34-41, wherein the plurality of fins defines an outer diameter for the torpedo anchor that is at least twice an outer diameter of the cylindrical body.

Example 43. The torpedo anchor of example 33 or any one of examples 34-42, wherein the exterior cylindrical surface comprises a patterned surface that is configured to reduce a drag of the torpedo anchor through water.

Example 44. The torpedo anchor of example 33 or any one of examples 34-43, comprising:

an annular collar coupled to the tail end of cylindrical body and aligned therewith, the annular collar comprising:

an exterior circumferential surface that is configured to extend the exterior cylindrical surface, and a pad eye extending outward from the exterior circumferential surface and formed of a metal or metal alloy.

Example 45. The torpedo anchor of example 44, wherein the exterior circumferential surface tapers an outer diameter of the annular collar along a direction away from the tail end of the cylindrical body.

Example 46. The torpedo anchor of example 33 or any one of examples 34-45, wherein the cast material is a cast cementitious material.

Example 47. The torpedo anchor of example 33 or any one of examples 34-45, wherein the cast material is a cast aluminum material.

Example 48. The torpedo anchor of example 33 or any one of examples 34-45, wherein the cast material is a cast iron material.

In some aspects of what is described, a method of manufacturing a torpedo anchor may be described by the following examples. The torpedo anchor is formed at least in part of cast material, and in certain cases, is configured to secure floating structures to an underwater floor. However, other types of structures are possible (e.g., submersible structures, underwater structures, etc.).

Example 49. A method of manufacturing a torpedo anchor, the method comprising:

disposing a castable material into a formwork or mold that defines a surface of the torpedo anchor, the torpedo anchor comprising:

a cylindrical body having an exterior cylindrical surface that:

tapers into a tip at a nose end of the cylindrical body, the tip configured to penetrate an underwater floor, and tapers an outer diameter of the cylindrical body at a tail end of the cylindrical surface; and a plurality of fins disposed proximate the tail end and extending outward from the exterior cylindrical surface, each fin formed at least in part of the castable material and comprising:

a base portion adjacent the exterior cylindrical surface; and a thickness that tapers along a direction away from the base portion.

solidifying the castable material in the formwork or mold to form a solidified body that defines at least part of the torpedo anchor, the solidified body comprising the surface.

Example 50. The method of example 49, comprising:

removing the formwork or mold from the solidified body.

Example 51. The method of example 49 or example 50, wherein each fin comprises leading and trailing edges that face towards, respectively, the nose and tail ends of the cylindrical body; and wherein the thickness of each fin tapers along a direction from the leading edge to the trailing edge.

Example 52. The method of example 49 or any one of examples 50-51, wherein the cylindrical body comprises:

an interior cavity that extends from the tail end towards the nose end, the tail end comprising an opening to the interior cavity; and a tubular wall encircling the interior cavity and comprising the exterior cylindrical surface.

Example 53. The method of example 52, wherein the solidified body defines all of the torpedo anchor; and wherein the method comprises disposing ballast into the interior cavity.

Example 54. The method of example 49 or any one of examples 50-53, wherein the cylindrical body has a portion that comprises a pad eye.

Example 55. The method of example 54, wherein the portion is disposed at the tail end of the cylindrical body.

Example 56. The method of example 49 or any one of examples 50-55, wherein at least one fin has a portion that comprises a pad eye.

Example 57. The method of example 49 or any one of examples 50-56, wherein at least one fin has an extension length along the cylindrical body that follows a curved pathway.

Example 58. The method of example 49 or any one of examples 50-57, wherein each fin extends along the cylindrical body at least half a length of the cylindrical body.

Example 59. The method of example 49 or any one of examples 50-58, wherein the plurality of fins defines an outer diameter for the torpedo anchor that is at least twice an outer diameter of the cylindrical body.

Example 60. The method of example 49 or any one of examples 50-59, wherein the exterior cylindrical surface comprises a patterned surface that is configured to reduce a drag of the torpedo anchor through water.

Example 61. The method of example 49 or any one of examples 50-60, wherein the castable material is a flowable cementitious material; and wherein disposing a castable material comprises casting the flowable cementitious material into the formwork or mold that defines the surface of the torpedo anchor.

Example 62. The method of example 60, comprising:

disposing reinforcing elements into the flowable cementitious material before casting the flowable cementitious material into the formwork or mold.

Example 63. The method of example 49 or any one of examples 50-60, wherein the castable material is a molten metal material;

wherein the method comprises heating a metal material to form the molten metal material; and wherein disposing a castable material comprises casting the molten metal material into the formwork or mold that defines the surface of the torpedo anchor.

Example 64. The method of example 63, wherein the metal material is an aluminum material.

Example 65. The method of example 63, wherein the metal material is an iron material.

In some aspects of what is described, a method of deploying a torpedo anchor may be described by the following examples. The torpedo anchor may, in certain cases, is configured to secure floating structures to an underwater floor. However, other types of structures are possible (e.g., submersible structures, underwater structures, etc.).

Example 66. A method of deploying a torpedo anchor, the method comprising:

coupling the torpedo anchor to an unmanned aerial vehicle (UAV) to produce a laden UAV, the torpedo anchor comprising a cylindrical body that has:

nose and tail ends, and an exterior cylindrical surface that tapers into a tip at the nose end;

moving, by operation of a propulsion system of the UAV, the laden UAV to a target position over a body of water; and releasing the torpedo anchor from the laden UAV, thereby allowing the torpedo anchor to enter the body of water below the target position.

Example 67. The method of example 66, wherein the target position comprises a target height over the body of water, the target height based on a target velocity for the torpedo anchor to penetrate into an underwater floor below the target position.

Example 68. The method of example 66 or example 67, wherein the torpedo anchor comprises a mooring line and a float coupled to an end of the mooring line.

Example 69. The method of example 68,
wherein a portion of the mooring line is coupled to the UAV; and
wherein releasing the torpedo anchor comprises releasing the portion of the mooring line from the laden UAV after the torpedo anchor has penetrated an underwater floor below the target location.

Example 70. The method of example 68 or example 69, wherein the float is coupled to the UAV; and
wherein releasing the torpedo anchor comprises releasing the float from the laden UAV after the torpedo anchor has penetrated an underwater floor below the target location.

Example 71. The method of example 66 or any one of examples 67-70, wherein the torpedo anchor comprises:
a plurality of fins disposed proximate the tail end of the cylindrical body and extending outward from the exterior cylindrical surface, each fin comprising:
a base portion adjacent the exterior cylindrical surface, and
a thickness that tapers along a direction away from the base portion.

Example 72. The method of example 71,
wherein each fin comprises leading and trailing edges that face towards, respectively, the nose and tail ends of the cylindrical body; and
wherein the thickness of each fin tapers along a direction from the leading edge to the trailing edge.

Example 73. The method of example 71 or example 72,
wherein at least one fin has an extension length along the cylindrical body that follows a curved pathway; and
wherein the method comprises rotating the torpedo anchor about a longitudinal axis of the cylindrical body in response to the at least one fin contacting one or both of the body of water or an underwater floor.

Example 74. The method of example 71 or any one of examples 72-73, wherein each fin extends along the cylindrical body at least half a length of the cylindrical body.

Example 75. The method of example 71 or any one of examples 72-74, wherein the plurality of fins defines an outer diameter for the torpedo anchor that is at least twice an outer diameter of the cylindrical body.

Example 76. The method of example 71 or any one of examples 72-75,
wherein at least one fin has a portion that comprises a pad eye; and
wherein the method comprises:
coupling a first end of a mooring line to a float, and
coupling a second end of the mooring line to the pad eye of the at least one fin.

Example 77. The method of example 66 or any one of examples 67-75,
wherein the cylindrical body comprises a pad eye at the tail end; and
wherein the method comprises:
coupling a first end of a mooring line to a float, and
coupling a second end of the mooring line to the pad eye of the cylindrical body.

Example 78. The method of example 66 or any one of examples 67-77, wherein the exterior cylindrical surface tapers an outer diameter of the cylindrical body at the tail end.

Example 79. The method of example 66 or any one of examples 67-78, wherein the exterior cylindrical surface comprises a patterned surface that is configured to reduce a drag of the torpedo anchor through water.

Example 80. The method of example 66 or any one of examples 67-79, wherein the cylindrical body comprises:
an interior cavity that extends from the tail end towards the nose end, the tail end comprising an opening to the interior cavity; and
a tubular wall encircling the interior cavity and comprising the exterior cylindrical surface.

Example 81. The method of example 80, wherein the torpedo anchor comprises ballast disposed in the interior cavity.

Example 82. The method of example 66 or any one of examples 67-75 and 78-81,
wherein the torpedo anchor comprises:
an annular collar coupled to the tail end of cylindrical body and aligned therewith, the annular collar comprising:
an exterior circumferential surface that is configured to extend the exterior cylindrical surface, and
a pad eye extending outward from the exterior circumferential surface and formed of a metal or metal alloy; and
wherein the method comprises:
coupling a first end of a mooring line to a float, and
coupling a second end of the mooring line to the pad eye of the annular collar.

Example 83. The method of example 82, wherein the exterior circumferential surface tapers an outer diameter of the annular collar along a direction away from the tail end of the cylindrical body.

Example 84. The method of example 66 or any one of examples 67-83, wherein the UAV comprises:
a locking mechanism displaceable between a first position, where the locking mechanism couples the torpedo anchor to the UAV, and a second position, where the locking mechanism uncouples the torpedo anchor from the UAV;
an actuator configured to actuate the locking mechanism from:
the first position to the second position in response to receiving an unlock signal, and
the second position to the first position in response to receiving a lock signal; and
a control system in communication with the actuator and configured to generate the lock and unlock signals.

Example 85. The method of example 84,
wherein the method comprises determining, by operation of a navigation system, a position of the UAV relative to the target position; and
wherein releasing the torpedo anchor from the laden UAV comprises transmitting, by operation of the navigation system, a release signal to the control system to generate the unlock signal when the laden UAV reaches the target position over the body of water.

Example 86. The method of example 85, wherein the UAV comprises the navigation system.

Example 87. The method of example 85, wherein the navigation system is part of a remote system.

Example 88. The method of example 84, wherein the method comprises determining, by operation of a LIDAR system, a position of the UAV relative to the target position; and wherein releasing the torpedo anchor from the laden UAV comprises transmitting, by operation of the LIDAR system, a release signal to the control system to generate the unlock signal when the laden UAV reaches the target position over the body of water.

Example 89. The method of example 88, wherein the UAV comprises the LIDAR system.

Example 90. The method of example 88, wherein the LIDAR system is part of a remote system.

Example 91. The method of example 84, wherein the method comprises determining, by operation of an optical imaging system, a position of the UAV relative to the target position; and wherein releasing the torpedo anchor from the laden UAV comprises transmitting, by operation of the optical imaging system, a release signal to the control system to generate the unlock signal when the laden UAV reaches the target position over the body of water.

Example 92. The method of example 91, wherein the UAV comprises the optical imaging system.

Example 93. The method of example 91, wherein the optical imaging system is part of a remote system.

Example 94. The method of example 84, wherein the method comprises determining, by operation of an acoustic sensing system, a position of the UAV relative to the target position; and wherein releasing the torpedo anchor from the laden UAV comprises transmitting, by operation of the acoustic sensing system, a release signal to the control system to generate the unlock signal when the laden UAV reaches the target position over the body of water.

Example 95. The method of example 94, wherein the UAV comprises the acoustic sensing system.

Example 94. The method of example 94, wherein the acoustic sensing system is part of a remote system.

Example 97. The method of example 84, wherein the method comprises determining, by operation of a local positioning system, a position of the UAV relative to the target position; and wherein releasing the torpedo anchor from the laden UAV comprises transmitting, by operation of the local positioning system, a release signal to the control system to generate the unlock signal when the laden UAV reaches the target position over the body of water.

Example 98. The method of example 97, wherein the local positioning system comprises three or more beacons disposed respective reference positions in a local environment of the laden UAV; and wherein the UAV comprises an electronic tag in communication with the local positioning system.

While this specification contains many details, these should not be understood as limitations on the scope of what may be claimed, but rather as descriptions of features specific to particular examples. Certain features that are described in this specification or shown in the drawings in the context of separate implementations can also be combined. Conversely, various features that are described or shown in the context of a single implementation can also be implemented in multiple embodiments separately or in any suitable sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single product or packaged into multiple products.

A number of embodiments have been described. Nevertheless, it will be understood that various modifications can be made. Accordingly, other embodiments are within the scope of the following claims.

What is claimed is:

1. A torpedo anchor, comprising:

a cylindrical body having first and second ends and an exterior cylindrical surface, the cylindrical body formed of cementitious material and comprising an interior cavity that extends through the cylindrical body between the first and second ends, the first and second ends comprising respective openings to the interior cavity, the interior cavity defining a conduit that is configured to contain a shaft;

a plurality of fins disposed proximate the second end and extending outward from the exterior cylindrical surface, each fin formed at least in part of cementitious material; and the shaft, disposed through the conduit and comprising:

a shaft wall formed of a metal or metal alloy and defining an exterior shaft surface, the exterior shaft surface tapering into a tip at a nose end of the shaft, the tip configured to penetrate an underwater floor, and a tail end residing proximate the second end of the cylindrical body.

2. The torpedo anchor of claim 1, wherein the exterior cylindrical surface tapers an outer diameter of the cylindrical body at one or both of the first and second ends.

3. The torpedo anchor of claim 1, wherein the shaft comprises a pad eye.

4. The torpedo anchor of claim 1, wherein the shaft comprises an annular protrusion from the exterior shaft surface that is located proximate the tail end of the shaft.

5. The torpedo anchor of claim 1, wherein the cylindrical body comprises a portion that is formed of metal or a metal alloy, the portion comprising a pad eye.

6. The torpedo anchor of claim 1, wherein at least one fin comprises:

a base portion adjacent the exterior cylindrical surface; and a thickness that tapers along a direction away from the base portion.

7. The torpedo anchor of claim 1, wherein at least one fin comprises leading and trailing edges that face towards, respectively, the first and second ends of the cylindrical body; and wherein a thickness of the at least one fin tapers along a direction from the leading edge to the trailing edge.

8. The torpedo anchor of claim 1, wherein each fin extends along the cylindrical body at least half a length of the cylindrical body.

9. A method of manufacturing a torpedo anchor, the method comprising:

displacing a flowable cementitious material to form a cylindrical body and a plurality of fins, wherein:

the cylindrical body has first and second ends and an exterior cylindrical surface, the cylindrical body comprising an interior cavity that extends through the cylindrical body between the first and second ends, the first and second ends comprising respective openings to the interior cavity, the interior cavity defining a conduit that is configured to contain a shaft, and the plurality of fins is disposed proximate the second end and extends outward from the exterior cylindrical surface, each fin formed at least in part of the flowable cementitious material;

hardening the flowable cementitious material into a solidified cementitious material; and disposing a shaft through the conduit that comprises a shaft wall formed of a metal or metal alloy and defines an exterior shaft surface, the exterior shaft surface tapering into a tip at a nose end of the shaft, the tip configured to penetrate an underwater floor.

10. The method of claim 9, wherein displacing a flowable cementitious material comprises depositing layers of the flowable cementitious material on top of each other to form the cylindrical body and the plurality of fins.

11. The method of claim 9, wherein displacing a flowable cementitious material comprises casting a flowable cementitious material into a formwork that defines a surface of the cylindrical body and the plurality of fins.

* * * * *